US005717420A

United States Patent [19]

Matsuzaki et al.

[11] Patent Number: 5,717,420

[45] Date of Patent: Feb. 10, 1998

[54] DISPLAY CONTROL APPARATUS AND METHOD

[75] Inventors: Eiichi Matsuzaki, Kawasaki; Hiroshi Nonoshita, Fujisawa; Yoshitsugu Yamanashi, Tokyo; Takayuki Seki, Kawasaki, all of Japan

[73] Assignee: Canon Kabushiki Kaisha, Tokyo, Japan

[21] Appl. No.: 436,596

[22] Filed: May 8, 1995

Related U.S. Application Data

[63] Continuation of Ser. No. 23,115, Feb. 26, 1993, abandoned.

[30] Foreign Application Priority Data

| | | | |
|---|---|---|---|
| Feb. 28, 1992 | [JP] | Japan | 4-043357 |
| Feb. 28, 1992 | [JP] | Japan | 4-043358 |
| Jun. 22, 1992 | [JP] | Japan | 4-162947 |

[51] Int. Cl.[6] ..... G09G 3/36

[52] U.S. Cl. ..... 345/97; 345/98

[58] Field of Search ..... 345/97, 94, 101, 345/95, 98, 99, 87, 208, 210; 359/54, 56

[56] References Cited

U.S. PATENT DOCUMENTS

| | | | |
|---|---|---|---|
| 4,922,241 | 5/1990 | Inoue et al. | 340/784 |

FOREIGN PATENT DOCUMENTS

| | | | |
|---|---|---|---|
| 0318050 | 5/1989 | European Pat. Off. . | |
| 0368117 | 5/1990 | European Pat. Off. . | |
| 0464620 | 1/1992 | European Pat. Off. . | |
| 63-243922 | 10/1988 | Japan . | |
| 63-243993 | 10/1988 | Japan . | |
| 4-3112 | 1/1992 | Japan | 345/97 |
| 4-73618 | 3/1992 | Japan | 345/97 |

*Primary Examiner*—Regina Liang

*Attorney, Agent, or Firm*—Fitzpatrick, Cella, Harper & Scinto

[57] ABSTRACT

A display control apparatus for a display apparatus having a display device in which a liquid crystal such as a ferroelectric liquid crystal is used as an operating medium for display-updating and the updated display state can be held by applying an electric field or the like. The display control apparatus comprises a first updating circuit to update the display content of the entire screen of the display apparatus, a second updating circuit to update the display content of a part of the display screen, a detector to detect an external factor such as a temperature of the display apparatus, and a switching circuit to switch the first and second updating circuits in accordance with the detected external factor.

12 Claims, 19 Drawing Sheets

INTERLACE MODE
REFRESH/PARTIAL REWRITE
47
DISPLAY MODE TABLE
43
44
45
46
42
COMPARATOR CCT
41
COMPARATOR f≧a
COMPARATOR f≧b
COMPARATOR f≧c
a
b
c
48
PARAMETER DETERMINER
f

FIG. 13

| FLAG COUNTER VALUE | DISPLAY MODE |
|---|---|
| 0 ~ 1 | TOTAL REFRESH |
| 2 ~ 4 | PARTIAL REWRITE |
| 5 ~ | TOTAL REFRESH |

FIG. 14

| TEMPERATURE CONDITION | FLAG COUNTER VALUE | DISPLAY MODE |
|---|---|---|
| 0 | 0 | TOTAL REFRESH |
| | 1 ~ 3 | PARTIAL REWRITE |
| | 4 ~ | TOTAL REFRESH |
| 1 | 0 ~ 1 | TOTAL REFRESH |
| | 2 ~ 4 | PARTIAL REWRITE |
| | 5 ~ | TOTAL REFRESH |
| 2 | 0 ~ 2 | PARTIAL REWRITE |
| | 3 ~ 6 | TOTAL REFRESH |
| | 7 ~ 8 | PARTIAL REWRITE |
| | 9 ~ | TOTAL REFRESH |
| 3 | 0 ~ 10 | PARTIAL REWRITE |
| | 11 ~ 20 | TOTAL REFRESH |
| | 21 ~ 50 | PARTIAL REWRITE |
| | 51 ~ | TOTAL REFRESH |

FIG. 22

| TEMPERATURE CONDITION | TABLE NO. | FLAG COUNTER VALUE | NO. OF PARTIAL REWRITE OPERATIONS |
|---|---|---|---|
| 0 0 | 0 | 0 | 0 |
| | | 1 ~ 3 | = FLAG COUNTER VALUE |
| | | 4 ~ | 4 |
| 0 1 | 1 | 0 | 0 |
| | | 1 ~ 5 | = FLAG COUNTER VALUE |
| | | 6 ~ | 6 |
| 1 0 | 2 | 0 | 0 |
| | | 1 ~ 10 | = FLAG COUNTER VALUE |
| | | 11 ~ | 11 |
| 1 1 | 3 | 0 | 0 |
| | | 1 ~ 50 | = FLAG COUNTER VALUE |
| | | 51 ~ | 20 |

DISPLAY CONTROL APPARATUS AND METHOD

This application is a continuation of application Ser. No. 08/023,115, filed Feb. 26, 1993, now abandoned.

BACKGROUND OF THE INVENTION

1. Field of the Invention

The present invention relates to a display control apparatus and, more particularly, to a display control apparatus for a display apparatus having a display device which uses, for example, a ferroelectric liquid crystal as an operating medium to update a display content and can hold a display state updated by applying an electric field or the like.

2. Related Background Art

Generally, in an information processing system or the like, a display apparatus is used as information display means for performing a visual expressing function of information. A CRT display apparatus is widely known as such a display apparatus.

In the display control in the CRT display apparatus, a writing operation of the CPU on the system side into a video memory as a display data buffer which the CRT side has and reading and display operations of the display data from the video memory by, for instance, a CRT controller which the CRT side has, are respectively independently executed.

In case of the display control of the CRT as mentioned above, the writing operation of the display data into the video memory in order to change display information or the like and the operation to read out the display data from the video memory and to display are independent. Therefore, there is an advantage such that in a program on the information processing system side, there is no need to consider a display timing or the like and desired display data can be written at an arbitrary timing.

On the other hand, however, since the CRT needs a certain extent of length in the direction of thickness of the display screen, in particular, a volume of the entire CRT is large and it is difficult to miniaturize the entire display apparatus. Due to this, when the information processing system using such a CRT as a display is used, degrees of freedom, namely, degrees of freedom regarding the installing location, portability, and the like are lost.

A liquid crystal display (hereinafter, referred to as an LCD) can be used as an apparatus for eliminating such a disadvantage. That is, according to the. LCD, the entire display apparatus can be miniaturized (particularly, thickness can be made reduced). Among such LCD, there is a display apparatus using a liquid crystal cell of the foregoing ferroelectric liquid crystal (hereinafter, referred to as an FLC) (such a display is hereinafter referred to as an FLC display or FLCD). One of the features of the FLCD is that a liquid crystal cell has a preserving performance of the display state for the apply of an electric field. Namely, according to the FLCD, the liquid crystal cell is thin enough and elongated molecules of the FLC in the liquid crystal cell are oriented in the first or second stable state in accordance with the applying direction of the electric field. Even when the electric field is eliminated, each orienting state is maintained. Due to the bistability of such FLC molecules, the FLCD has a memory performance. Such FLC and FLCD are disclosed in detail in, for example, Japanese Patent Application No. 62-76357.

In case of driving the FLCD, accordingly, different from the CRT or other liquid crystal displays, there is a time allowance in a period of time to continuously refresh and drive the display screen. In addition to the continuous refresh driving, it is possible to perform partial rewrite driving to update the display state of only the portion corresponding to a change on the display screen.

In the FLCD, in case of using the FLCD as a display apparatus of the information processing system by a display control similar to that of the CRT, since a time which is needed to the display updating operation of the FLC is relatively short, for instance, there is a case where it is impossible to follow a change in display information such that the display must be immediately rewritten like a cursor, character input, scroll, or the like. Therefore, it is necessary to improve an apparent display speed by executing a partial rewrite driving as a feature of the FLCD. On the other hand, if such an FLCD can be used as a display apparatus of the information processing system so as to be compatible with the CRT, flexibility of the system increases and its value can be raised. However, in the case where the operator wants to add identification (ID) information indicative of a change in display state which needs the partial rewrite driving like the cursor, character input, scroll, or the like mentioned above and to subsequently process the display data, a large change occurs in a software in the information processing system and the compatibility of the program cannot be accomplished. Even when the partial rewriting operation is executed, the display quality differs depending on a selecting method of the portion to be partially rewritten.

SUMMARY OF THE INVENTION

It is an object of the present invention to provide a display apparatus which can properly execute a partial rewrite driving at a suitable timing while guaranteeing a compatibility among different display media when they are seen from a software.

BRIEF DESCRIPTION OF THE DRAWINGS

FIG. 13 is a diagram showing the relation between the flag counter values and the display mode;

FIG. 14 is a diagram showing the relations among the temperature condition, the flag counter value, and the display mode;

FIG. 22 is a diagram showing the relations among the temperature condition, the table No., the flag counter value, and the number of partial rewrite operations.

DETAILED DESCRIPTION OF THE PREFERRED EMBODIMENTS

Embodiments of the present invention will now be described in detail hereinbelow with reference to the drawings.

(Embodiment 1)

Figure 1:
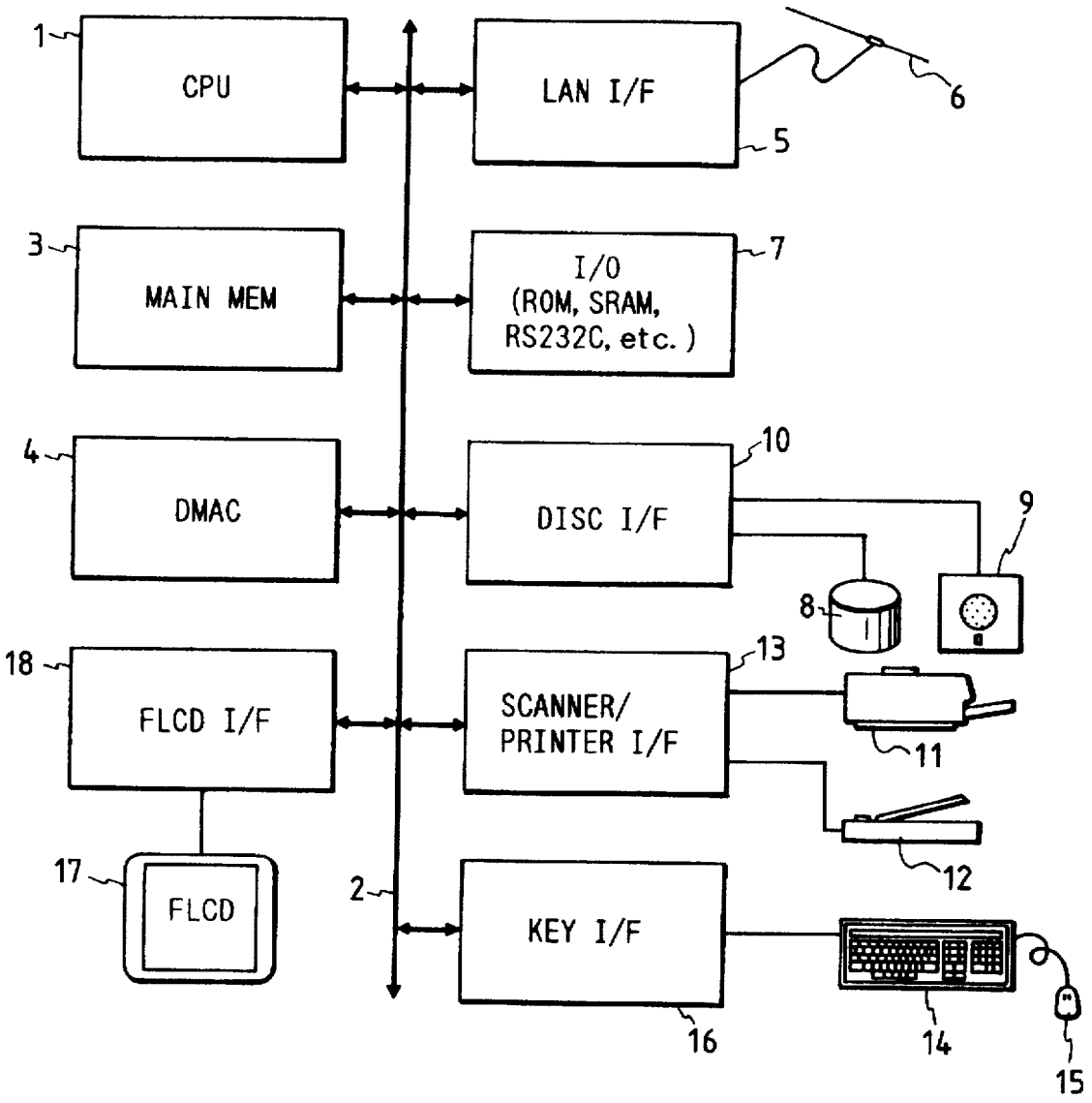
FIG. 1 is a block constructional diagram of an entire information processing apparatus in which a display control apparatus according to an embodiment of the present invention is assembled.

FIG. 1 is a block constructional diagram of an entire information processing system in which a display control apparatus according to an embodiment of the invention is assembled.

In the diagram, reference numeral 1 denotes a CPU to control the entire information processing system; 2 a system bus which is constructed by an address bus, a control bus, and a data bus; 3 a main memory which is used to store a program or is used as a work area; 4 a DMA controller (Direct Memory Access Controller: hereinafter, simply referred to as a DMAC) to transfer data between the memory and an I/O apparatus without being controlled by a CPU; 5 an LAN interface to interface with an LAN (Local Area Network); 6 such as an Ethernet (by XEROX Co., Ltd.) or the like; 7 an I/O device which is constructed by a ROM, an SRAM, an RS232C interface, and the like and is used to connect I/O apparatuses; 8 a hard disc device; 9 a floppy disk device; 10 a disc interface to interface with the hard disc device 8 or floppy disk device 9; 11 a printer such as a laser beam printer, an ink jet printer, or the like; 12 a scanner as an image reading apparatus; 13 an interface to interface with the printer 11 and scanner 12; 14 a keyboard to input characters, numerical values, and the like; 15 a mouse serving as a pointing device to move a cursor position; 16 an interface to interface with the keyboard 14 and mouse 15; 17 an FLCD (FLC display) which can be constructed by using, for example, a display disclosed in JP-A-63-243993 by the same applicant as the present invention or the like; and 18 an FLCD interface to interface with the FLCD 17.

In the information processing system to which the above-described various kinds of apparatuses and the like are connected, the user of the system generally performs the operation in correspondence to various information which is displayed on the display screen of the FLCD 17. That is, characters, image information, or the like which is supplied from an external apparatus that is connected to the LAN 6 and I/O device 7, the hard disc device 8, floppy disk device 9, scanner 12, keyboard 14, or mouse 15, the operation information which is stored into the main memory 3 and is concerned with the system operation of the user, or the like is displayed on the display screen of the FLCD 17. The user executes the edition of the information and the instructing operation to the system while looking at the displayed content on the screen. The above various kinds of apparatuses construct display information supply means to the FLCD 17.

Figure 2:
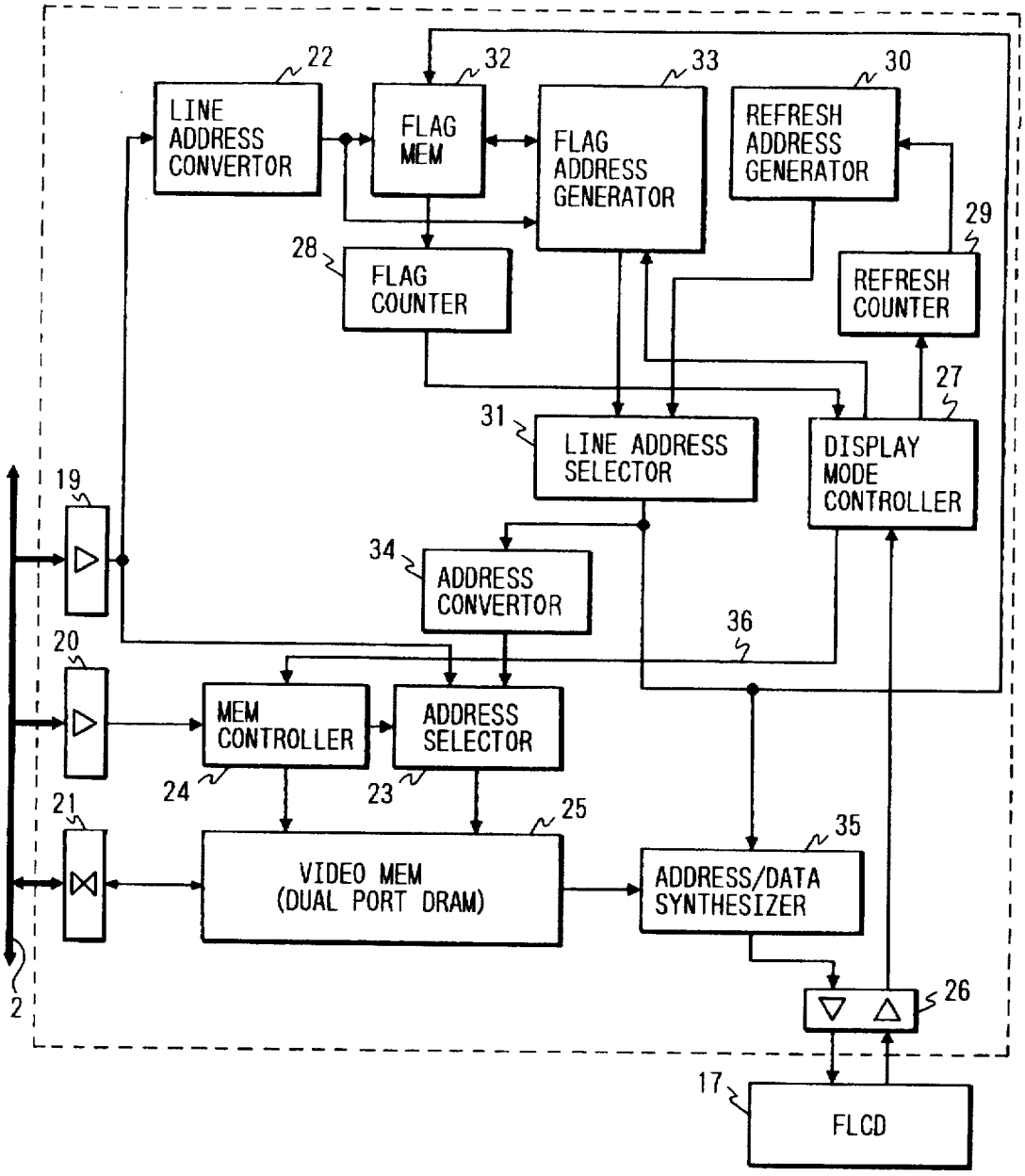
FIG. 2 is block diagram showing a construction of an FLCD interface as an embodiment of the invention.

FIG. 2 is a block diagram showing an example of construction of the FLCD interface 18 according to an embodiment of a display control apparatus of the present invention.

In the diagram, reference numeral 19 denotes an address bus driver; 20 a control bus driver; and 21 a data bus driver. An address from the CPU 1 is supplied from the address bus driver 19 to a line address converter 22 and one input terminal of an address selector 23.

A control signal which is supplied from the CPU 1 is transferred from the control bus driver 20 to a memory controller 24 through the system bus. The memory controller 24 generates a control signal of the address selector 23 and a control signal of a video memory 25, which will be explained hereinlater. On the basis of a control signal which is supplied from the memory controller 24, the address selector 23 selects one, of two addresses which are given to input terminals of the address selector 23 and gives the selected address to the video memory 25.

The video memory 25 stores the display data and is constructed by a dual port DRAM (dynamic RAM). The display data is written into and read out from the video memory 25 through the system bus 2 and data bus driver 21. The display data written in the video memory 25 is transferred and displayed to the FLCD 17 through an address/data synthesizer 35 and a driver receiver 26. The driver receiver 26 gives a sync signal from the FLCD 17 to a display mode controller 27. For instance, each time the total refresh of one picture plane is finished, the display mode controller 27 determines whether the total refresh, which will be explained hereinlater, is executed or the partial rewrite, which will be explained herein-later, is performed in accordance with the information from a flag counter 28. In case of performing the partial rewrite, the controller 27 decides the number of partial rewrite operations.

The total refresh is an operation to update the display content on the whole display screen in accordance with a predetermined order. The data is read out from the video memory 25 in accordance with a predetermined order and is transferred to the FLCD 17. The partial rewrite is an operation to preferentially display and update the location where the CPU 1 has changed the display content. The partial rewrite interrupts into a frame (one picture plane) that is being refreshed in accordance with a predetermined order. The relation between the total refresh and the partial rewrite will be described in detail hereinlater.

In case of performing the total refresh, the display mode controller 27 gives a control signal to a refresh counter 29 to thereby advance a counter value. The counter value from the refresh counter 29 is sent to a refresh address generator 30 and is converted into a line address to actually refresh the picture plane. The line address is supplied to one input terminal of a line address selector 31. In this instance, the line address selector 31 selects a line address which is supplied from the refresh address generator 30 and generates in accordance with a control signal which is supplied from the display mode controller 27. When the refresh counter 29 counts up one frame, it informs such fact to the display mode controller 27. By receiving such a notification, the display mode controller 27 determines the number of partial rewrite operations with reference to the counter value from the flag counter 28. Or, each time the partial rewrite is executed once, the display mode controller 27 refers to the counter value from the flag counter 28 and executes the partial rewrite a predetermined number of times. Or, when the counter value is equal to "0", the total refresh is again executed by an amount corresponding to one frame.

When the CPU 1 writes data into the video memory 25 or reads out data from the video memory 25, the line address converter 22 detects the writing operation into the display area in its access and converts the address which is supplied from the CPU 1 into the display line address of the FLCD 17 and gives the display line address to a flag memory 32. The flag memory 32 has a memory capacity of an amount of the display line address and indicates a flag to show whether the display line is a candidate of the line to be partial rewrite displayed or not. For instance, in the flag memory 32, the memory location corresponding to the line address in which the writing into the display area, namely, the change in display content has occurred is set into "1". This means that the display line is a candidate of the partial rewrite. On the other hand, the line address from the line address selector 31 is monitored and the memory location corresponding to the line address supplied to the FLCD 17 is set into "0". This means that the line address is supplied-to the FLCD 17 due to the total refresh or partial rewrite and the display content has been changed and the display line is out of the candidate of the partial rewrite. As mentioned above, in the flag memory 32, a flag of the line address in which the data writing has occurred is set to "1" by the CPU 1. When the line of the line address whose flag has been set to "1" is generated, the operation to set the flag into "0" is executed. In correspondence to the above operation, for example, the flag counter 28 counts up in the case where the flag is set to "1" (change from 0 to 1) in the flag memory 32. When the flag is set to "0" (change from 1 to 0), the flag counter 28 counts down. Due to this, the flag counter 28 indicates the number of flags of "1" in the flag memory 32. Although another means can be considered, by counting the number of flags set into "1" in the flag memory 32 by the flag counter 28, a degree of necessity of the partial rewrite is shown. An output of the flag counter 28 is given to the display mode controller 27.

The display mode controller 27 determines whether the operating mode is set into the total refresh mode or the partial rewrite mode on the basis of the counter value which is supplied from the flag counter 28.

A flag address generator 33 decides the line address in which the flag has been set to "1", namely, the partial rewrite is executed with reference to the flag memory 32 and gives the decided line address to one input terminal of the line address selector 31. In the case where the partial rewrite is instructed from the display mode controller 27, the line address selector 31 selects the line address that is supplied from the flag address generator 33 and generates the selected line address.

Figure 7:
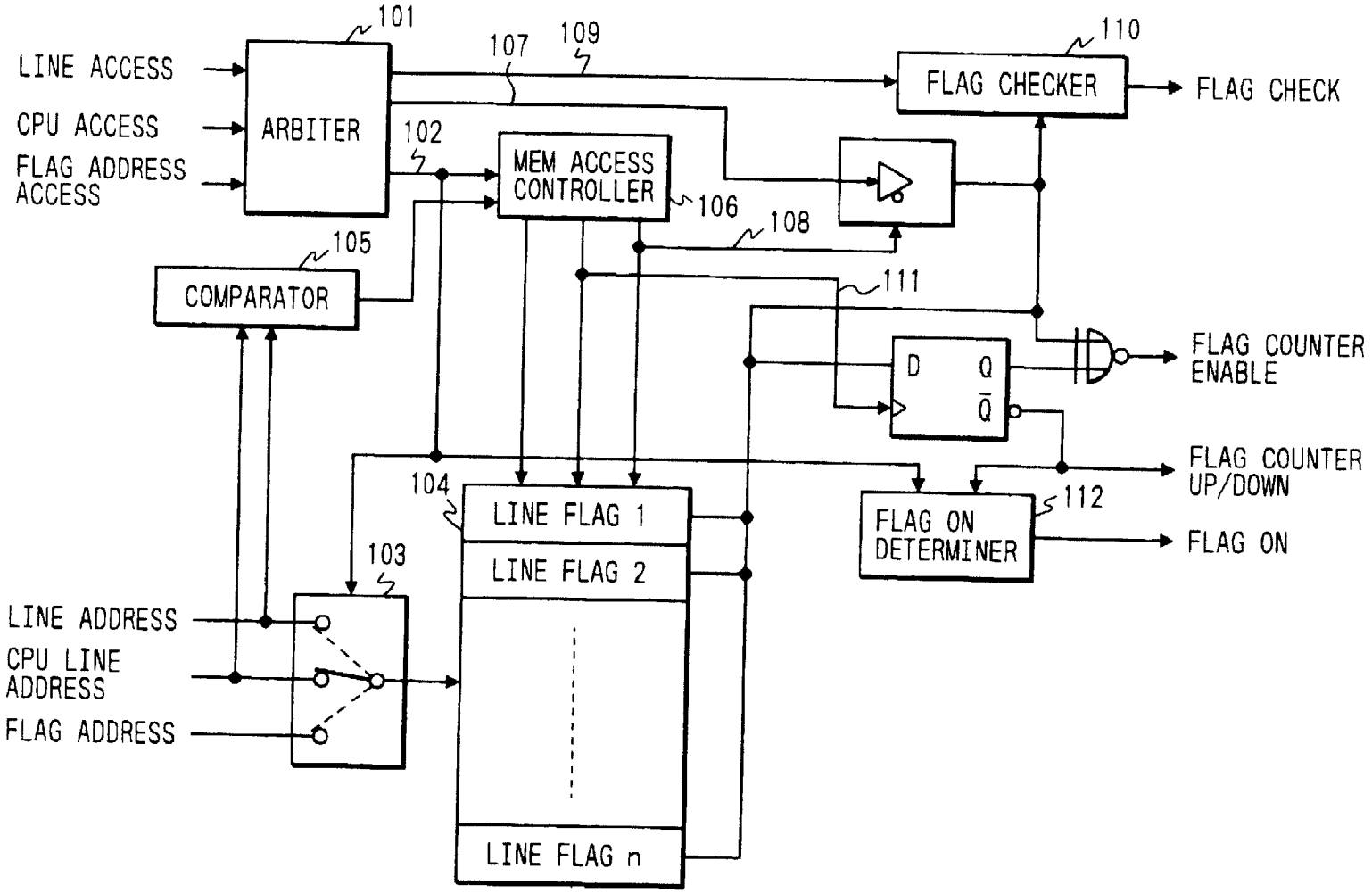
FIG. 7 is a block diagram showing an example of a construction of a flag memory.
Figure 9:
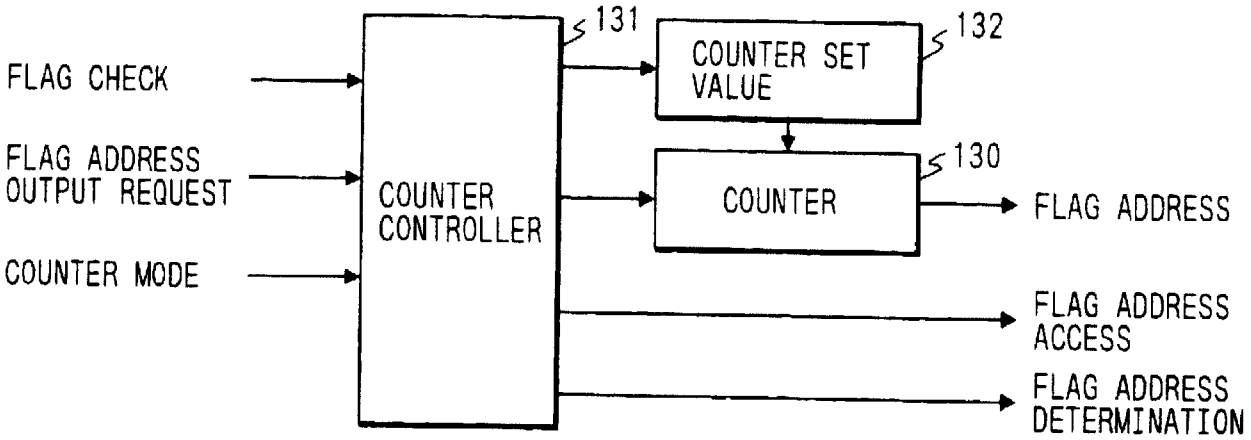
FIG. 9 is a block diagram showing an example in which the flag address generator is embodied by a counter.

FIG. 7 shows an example showing a construction of the flag memory 32. The line address which is supplied from the line address selector 31 and is sent to the FLCD 17, a CPU line address as a write address that is supplied from the CPU 1, and a flag address that is supplied from the flag address generator 33 are received as inputs of a selector 103. An arbiter 101 executes an arbitration about those three kinds of accesses and supplies an access kind signal 102 as a result of the arbitration to the selector 103. An output signal of the selector 103 is given as an address of a memory 104. For instance, priorities are sequentially set in accordance with the order of the CPU access (VRAM rewrite cycle), line access (refresh cycle), and flag address access (partial rewrite cycle). FIG. 9 shows an example of timings of the flag memory 32.

In the CPU access, the CPU line address is selected by the selector 103 and transferred into the memory 104. The CPU line address and the line address are supplied to a comparator 105. On the basis of the result of the comparison by the comparator 105 and the access kind signal 102, a memory access controller 106 detects the line at which the rewrite has occurred. That is, the flag is first read (flag memory read data). Just after the flag was read out, the flag data (flag memory write data) which is determined by a CPU/line signal 107 is written into the memory 104. A value of the CPU/line signal 107 is decided in accordance with the result of the judgment by the arbiter 101 with respect to whether the kind of access is the CPU access or the line access. A gate output of the CPU/line signal 107 is determined on the basis of a flag write signal 108 which is supplied from the memory access controller 106 and is used as flag data. In the embodiment, in the CPU access, the CPU/line signal 107= "1". In the line access, the CPU/line signal 107="0".

Figure 10:
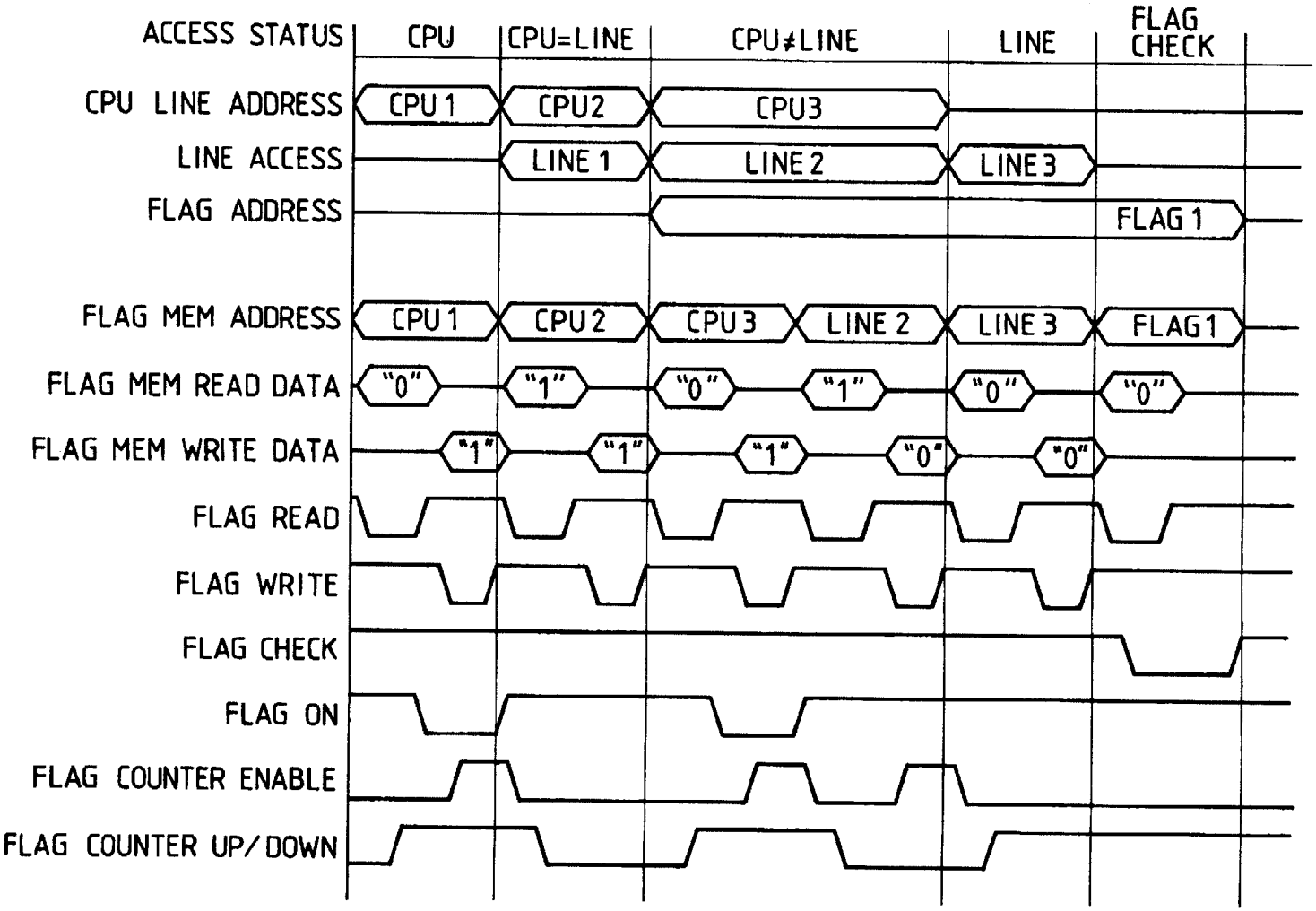
FIG. 10 is a timing chart in the example of the construction of the flag memory.

In the line access, the line address is selected by the selector 103 and supplied to the memory 104 and an operation similar to the CPU access is executed. The line access differs from the CPU access with respect to a point that the flag corresponding to the line supplied to the FLCD 17 is reset to "0" ("1"→"0"). When the CPU access and the line access compete, so long as the CPU line address coincides with the line address, a priority is given to the CPU access and only the process of the flag of the CPU access is executed as shown in an access status of the CPU=line in a timing example of FIG. 10. When the CPU line address differs from the line address, priority is given to the CPU access and the process of the flag is executed as shown in an access status of the CPU ≠line in the timing example of FIG. 10. Subsequently, the process of the flag for the line access is executed. The flag process is substantially the same as that in the single access. In a manner similar to the above, the flag is preferentially set in the CPU access and the priority of the line access is reduced and the flag is reset to "0". Due to this, in the competition between the CPU access and the line access, the flag is always set to "1" for the new CPU access and the flag of the line which has already been outputted to the FLCD 17 can be certainly reset to "0".

In the flag address access, the flag address is selected by the selector 103 and given to the memory 104. The flag is merely read out from the memory 104 by the memory access controller 106 and the writing operation is not performed. In the case where the flag access competes with another access, the flag process of the flag access is executed lastly as shown in the access status of the flag and CPU ≠line in the timing example of FIG. 10. In the embodiment, the flag counter 28 is constructed by an ordinary up/down counter and monitors the updating of the data into the flag memory 32, thereby counting the number of flags stored in the flag memory 32. As mentioned above, in the timing example of the flag memory 32 in FIG. 10, in case of the CPU access, the flag is first read out from the memory 104 by the memory access controller 106. The flag data is latched into a D-FF by a flag read signal 111. A negative logic output of the latch data is generated as a flag counter up/down signal of the flag counter 28. Further, the exclusive OR is got in order to judge whether the latch data and the write data of the flag coincide or not. When they coincide, the flag data is not updated, so that the flag counter 28 is not made operative. When they differ, the flag data has been updated, so that the flag counter 28 is made operative. In the embodiment, the negative logic of the exclusive OR is generated as a flag counter enable signal. In the flag counter 28, the counter is controlled by the flag counter up/down signal, flag counter enable signal, and flag write signal 108. Operations similar to those mentioned above are also executed as for the line access.

Figure 8:
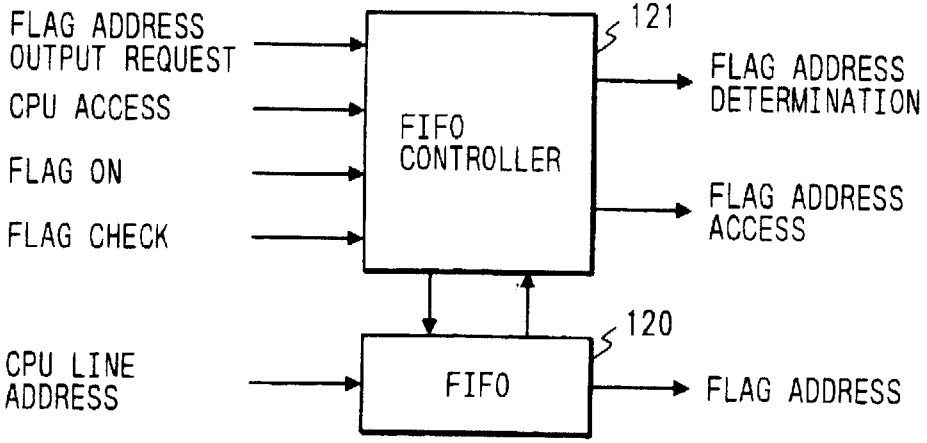
FIG. 8 is a block diagram showing an example in which a flag address generator is embodied by a FIFO.
Figure 11:
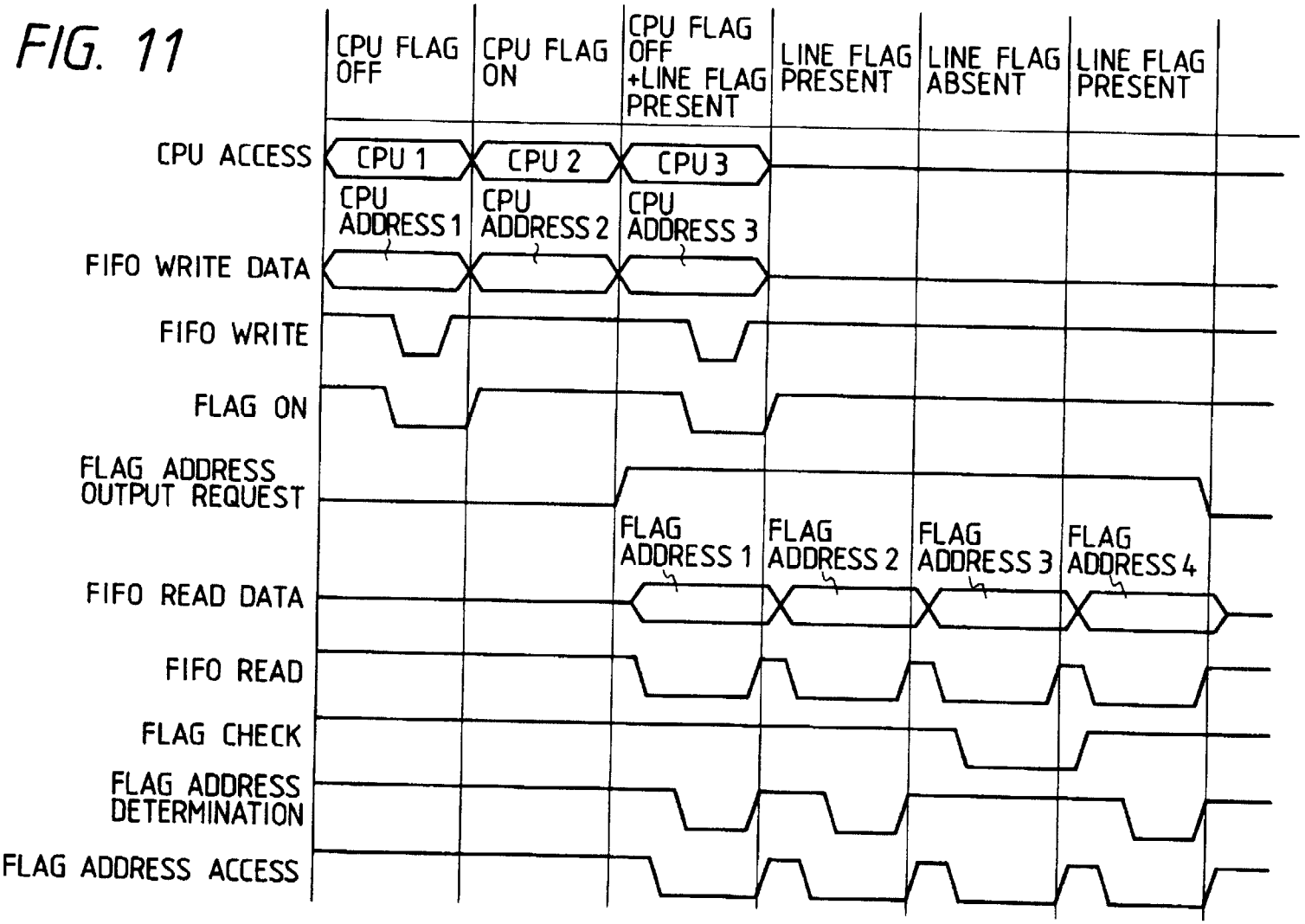
FIG. 11 is a timing chart when the flag address generator is embodied by a FIFO.

FIG. 8 shows an example in which a FIFO is used in the flag address generator 33. FIG. 11 shows a timing example of the flag address generator in FIG. 8. In the flag address generator 33 in FIG. 8, the input data to a FIFO 120 is a CPU line address (FIFO write data). Output data of the FIFO 120 is a flag address (FIFO read data) which is given to the line address selector 31. When the CPU access occurs, the CPU line address is sent to the FIFO 120 under the control of an FIFO controller 121. In order to avoid that the CPU line address is overlappingly stored into the FIFO 120, a flag ON determiner 112 of the flag memory 32 forms a flag ON signal on the basis of the access kind signal 102 which is generated from the arbiter 101 and the foregoing flag counter up/down signal. Namely, the flag ON signal is set to "1" when the flag is equal to "1". The flag ON signal is set to "0" when the flag is equal to "0". When the CPU access occurs and the flag ON signal is equal to "1", the FIFO controller 121 doesn't input the line address because it has already been stored in the FIFO 120. When the flag ON signal is equal to "0", since the line address is not yet stored in the FIFO 120, the FIFO controller 121 inputs the line address. In response to a flag address output request which is supplied from the display mode controller 27, the FIFO controller 121 sequentially generates the line addresses stored in the FIFO 120 as flag addresses. In this instance, a flag address access signal is simultaneously generated from the FIFO controller 121 and is used for arbitration of the accesses by the arbiter 101 of the flag memory 32. When the flag address gets the right to access, the flag address is supplied to the memory 104. In this instance, a flag checker 110 forms a flag check signal to judge the presence or absence of the flag on the basis of a flag address cycle signal 109 that is generated from the arbiter 101 and the flag data which has been read out from the memory 104. When the read-out flag is equal to "0", the flag check signal="0". When the read-out flag is equal to "1", the flag check signal="1". When the flag check signal="0", the FIFO controller 121 determines that the line address stored in the FIFO 120 has already been supplied to the FLCD 17, thereby allowing the flag address to be again generated from the FIFO 120. When the flag check signal="1", the FIFO controller 121 decides that the line address is not yet outputted. Therefore, the FIFO controller 121 generates a flag address determination signal together with the flag address. By receiving the flag address determination signal, the display mode controller 27 controls the line address selector 31 so as to output the flag address as a line address.

Figure 12:
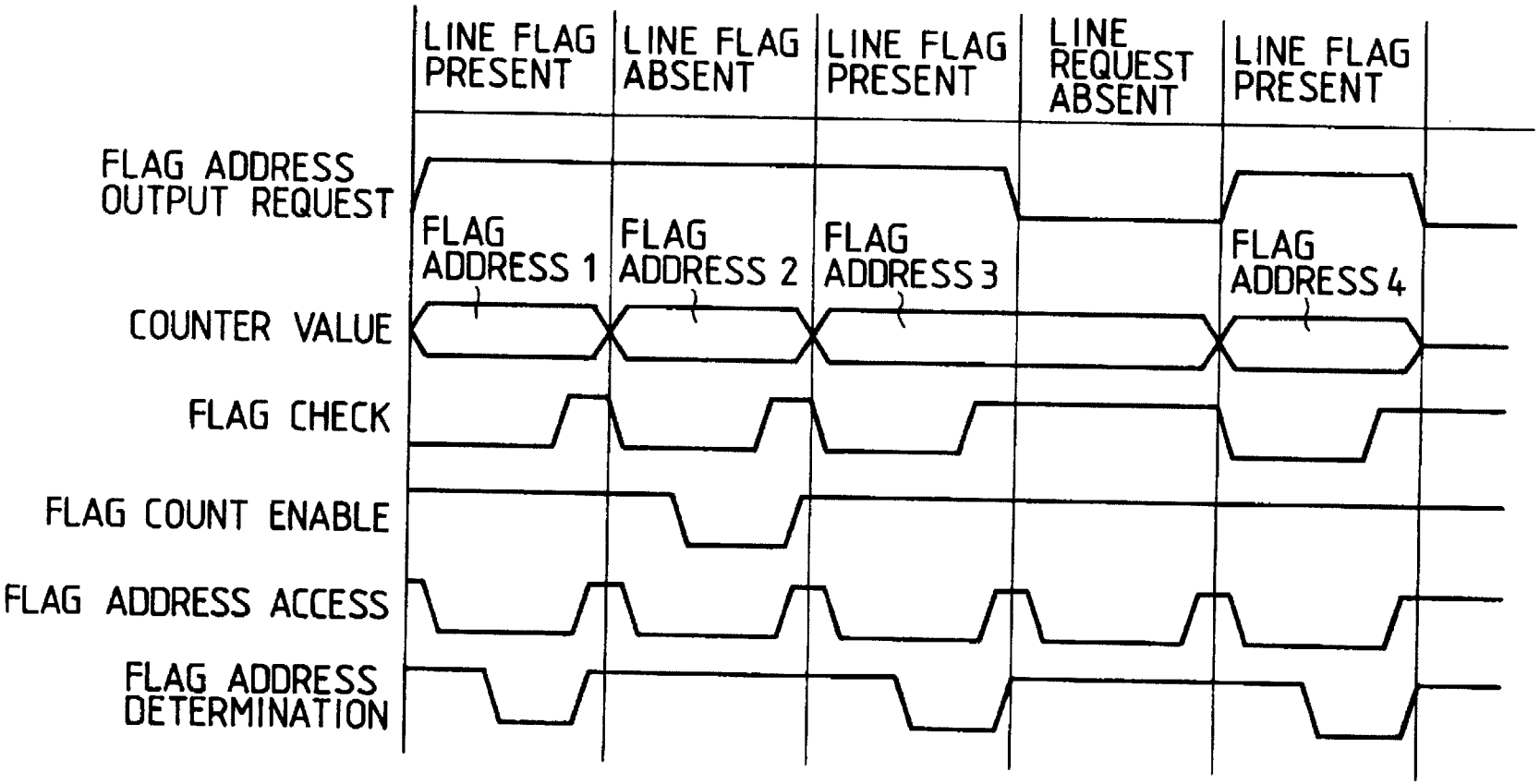
FIG. 12 is a timing chart when the flag address generator is embodied by a counter.

FIG. 9 shows an example in which a counter is used as another constructing means of the flag address generator 33. FIG. 12 shows a timing example of the flag address generator of FIG. 9. In the example of the flag address generator of FIG. 9, an output signal of a counter 130 is used as a flag address. In response to a flag address output request which is supplied from the display mode controller 27, a counter controller 131 allows the line addresses stored in the counter 130 to be sequentially generated as flag addresses. In this instance, a flag address access signal is simultaneously outputted from the counter controller 131. In a manner similar to the example of the FIFO mentioned above, the flag in the flag memory 32 is checked and the presence or absence of the flag is judged by the flag checker 110. When the flag check signal="0", the counter controller 131 determines that the line address stored in the counter 130 has already been supplied to the FLCD 17, so that the counter 130 continues the counting operation. When the flag check signal="1", the counter controller 131 decides that the line address is not yet outputted, so that the counter controller 131 stops the counting operation of the counter 130 and again generates the flag address determination signal by using the count value of the counter 130 as a flag address. By receiving the flag address determination signal, the display mode controller 27 controls the line address selector 31 so as to output the flag address as a line address. In the example of the above counter, a procedure to check the flag in the flag memory 32 can be changed in accordance with a method of loading the counter value. After the counter 130 was initialized, when the counter value is used without again loading the counter value, the partial rewrite mode operates so as to sequentially rewrite from the subsequent line after the line which has been rewritten just before. When the counter value is set to a value of a certain line, it is possible to operate so as to partially rewrite the region between the set line and the terminal count value of the counter 130. By changing the counter value, the area of the partial rewrite can be also successively changed. In place of the counter 130, it is also possible to use a sequencer and to realize the procedure to check the flag by a program.

On the other hand, by adding an address converter to the output signal of the counter 130, the partial rewrite mode can be also changed by the counter value of the flag counter 28. For instance, when the number of flags is equal to or less than a certain value, the noninterlace mode is set. That is, only the lines to be partially rewritten are sequentially outputted in accordance with the order from the upper line to the lower line. When the number of flags of "1" is larger than the certain value, the operating mode is changed to the interlace mode in the partial rewrite mode in accordance with the number of flags. That is, a function such that the lines to be partially rewritten are skipped and outputted can be easily added.

Means for constructing the flag address generator 33 by using a priority encoder will now be described.

Figure 19:
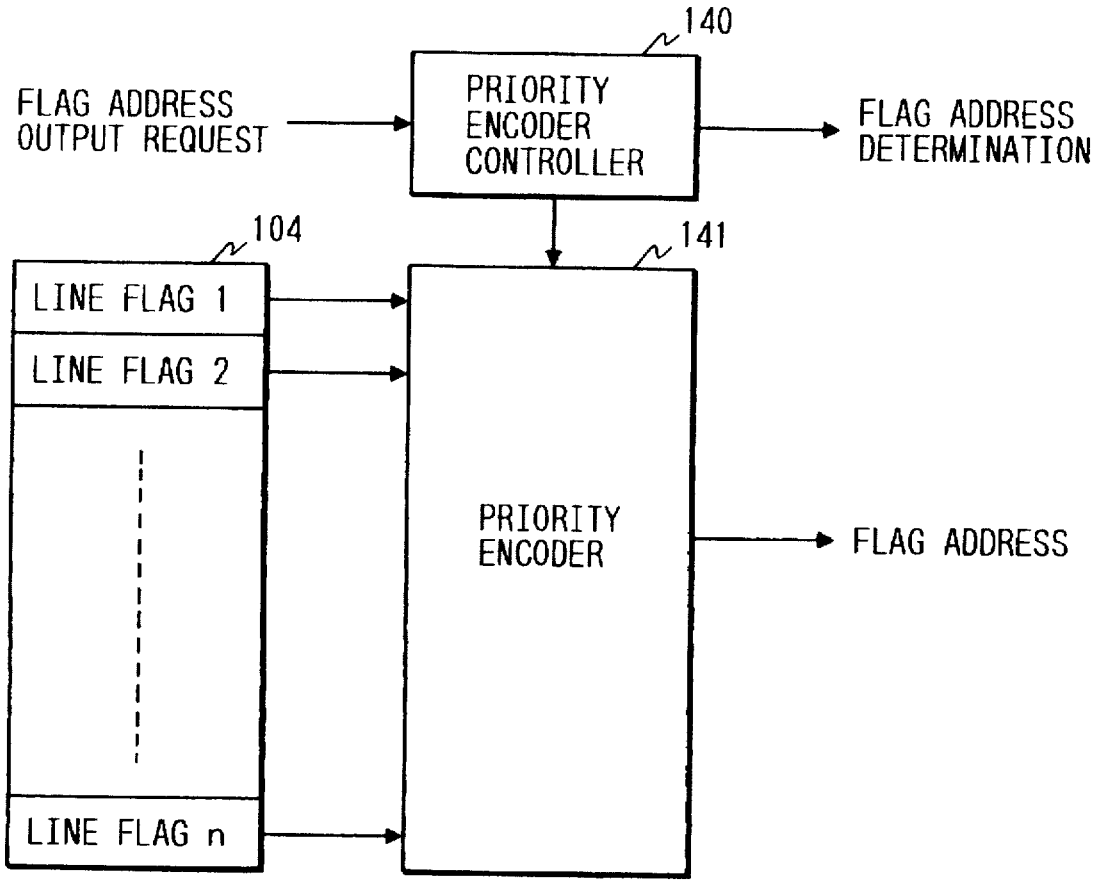
FIG. 19 is a block diagram showing an example in which the flag address generator is embodied by a priority encoder.
Figure 20:
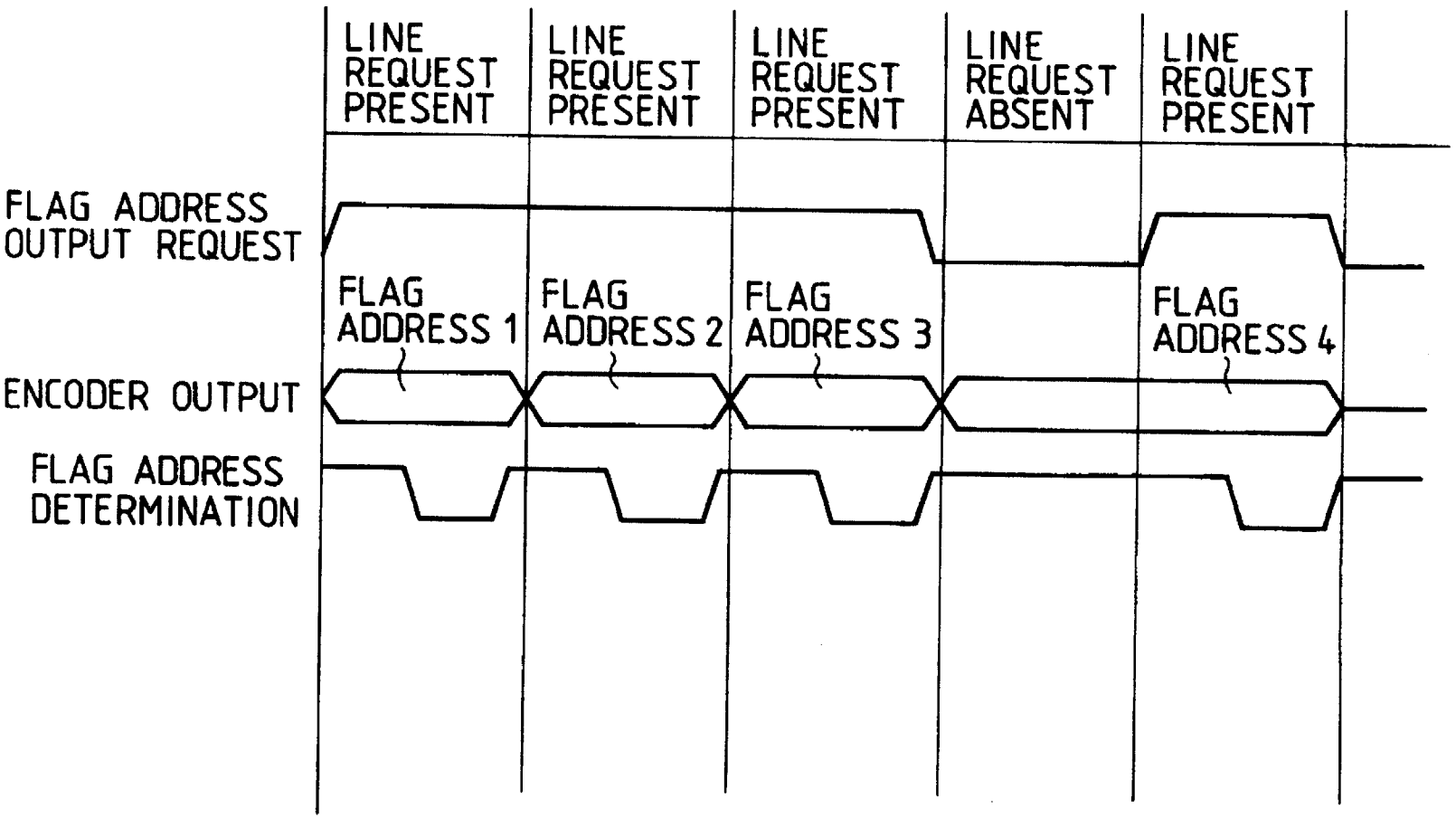
FIG. 20 is a timing chart in case of embodying the flag address generator by a priority encoder.

FIG. 19 shows a detailed block diagram of the flag address generator 33 according to the embodiment. FIG. 20 shows an example of timings of the flag address generator 33 in FIG. 19. In the example of the flag address generator of FIG. 19, an output signal of a priority encoder 141 is used as a flag address. The priority encoder 141 encodes output data of the memory 104 of the flag memory 32 and generates the result of the encoding as a flag address. When a flag address output request is generated from the display mode controller 27, a flag address determination signal indicative of the determination of the flag address is generated from the priority encoder controller 140. By receiving the flag address determination signal, the display mode controller 27 switches the line address selector 31 so as to generate the flag address as a line address. When the flag address is supplied as a line address to the FLCD 17, the memory location corresponding to the outputted line in the memory 104 of the flag memory 32 is set to "0". The priority encoder 141, therefore, subsequently encodes the line in which the flag has been set to "1" and generates as a flag address. When the priority encoder is used as flag address generating means as mentioned above, the address lines such that a change in display content has occurred as sequentially generated as flag addresses in accordance with the ascending order from the highest priority. Therefore, there is no need to check whether the flag has been set or not with respect to all of the flags as in case of using the FIFO or counter.

The line address generated from the line address selector 31 due to the total refresh and the partial rewrite is supplied to an address converter 34, address/data synthesizer 35, and flag memory 32.

In the address converter 34, the display line address is converted into the address of the DRAM in the video memory 25. The converted address is selected and outputted by the address selector 23 by a data transfer request 36 which is supplied from the display mode controller 27 to the memory controller 24. In this instance, in the video memory 25, a data transfer cycle occurs under control of the memory controller 24. The data stored at the position corresponding to the address which has been selected and outputted by the address selector 23 is read out from the DRAM and sent to the address/data synthesizer 35.

The address/data synthesizer 35 synthesizes the line address which is supplied from the line address selector 31 and the data which is supplied from the video memory 25 and transfers the synthesized data to the FLCD 17 through the driver receiver 26. Image data is displayed by the FLCD 17 on the basis of the synthesized data.

Figure 3:
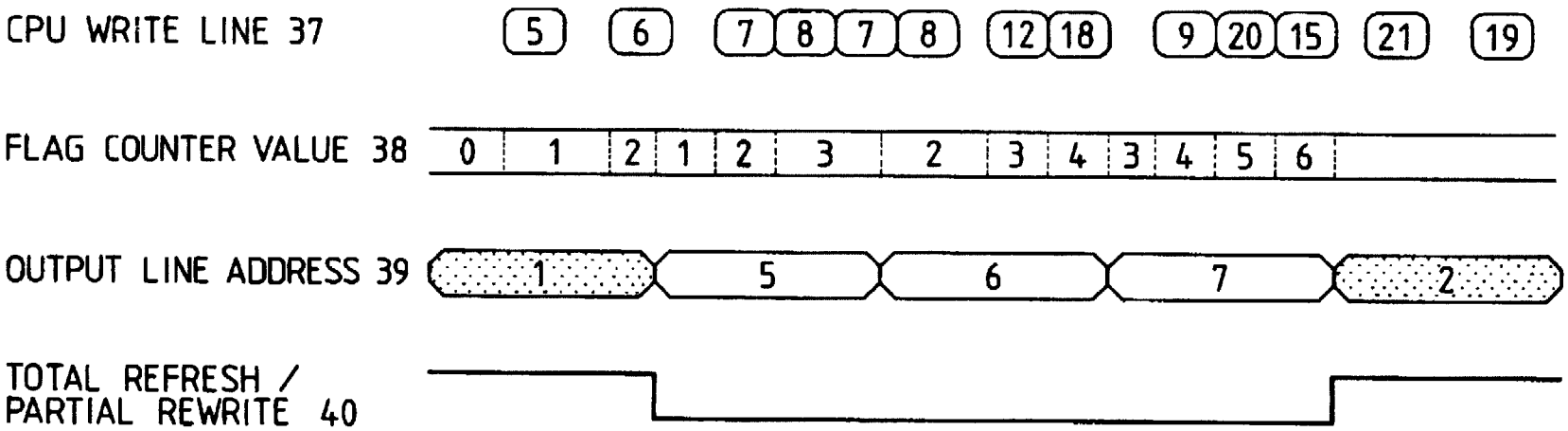
FIG. 3 is a timing chart for explaining the fundamental operation of the above FLCD interface.

FIG. 3 shows an example of the relation between the total refresh and the partial rewrite.

A write line 37 of the CPU denotes that the CPU 1 writes data into the display area in the video memory 25 through the address driver 19. A numerical value denotes a line address converted by the line address converter 22. A flag counter value 38 is 10 a value shown by the flag counter 28 and indicates the total number of lines which are not yet updated after the change in content of the memory occurred. An output line address 39 indicates a line address of the line data which is transferred to the FLCD 17 in accordance with the line address value generated from the line address selector 31. A total refresh/partial rewrite signal 40 denotes that the high level "1" indicates the total refresh cycle and the low level "0" indicates the partial rewrite cycle. The operation in the case where data has been written at a timing shown in the diagram will now be described hereinbelow.

The total refresh cycle and the partial rewrite cycle are determined by the display-mode controller 27 in accordance with FIG. 13.

First, the data of the first line of the display screen is supplied to the FLCD 17 in the total refresh cycle. The write mode occurs at the fifth and sixth lines during the outputting operation and the flag counter value 38 changes such that $0 \rightarrow 1 \rightarrow 2$. Since the flag counter value 38 is equal to "2" from FIG. 13, the partial rewrite cycle is set. The line address of "5" stored in the flag memory 32 is generated from the flag address generator 33. The data of the fifth line is sent to the FLCD 17. Although the data of the seventh and eighth lines is written during the above period of time, when the flag in the flag memory 32 is once set to "1", it is not reset to "0" until the line address is outputted. Therefore, in the overwriting mode, the flag counter value 38 is not counted up. That is, in the writing mode of the data of the 7th and 8th lines at the second time, the flag counter value 38 is not counted up. When the write instruction from the CPU 1 occurs a number of times and the flag counter value 38 exceeds "5", the total refresh cycle is set.

Figure 4:
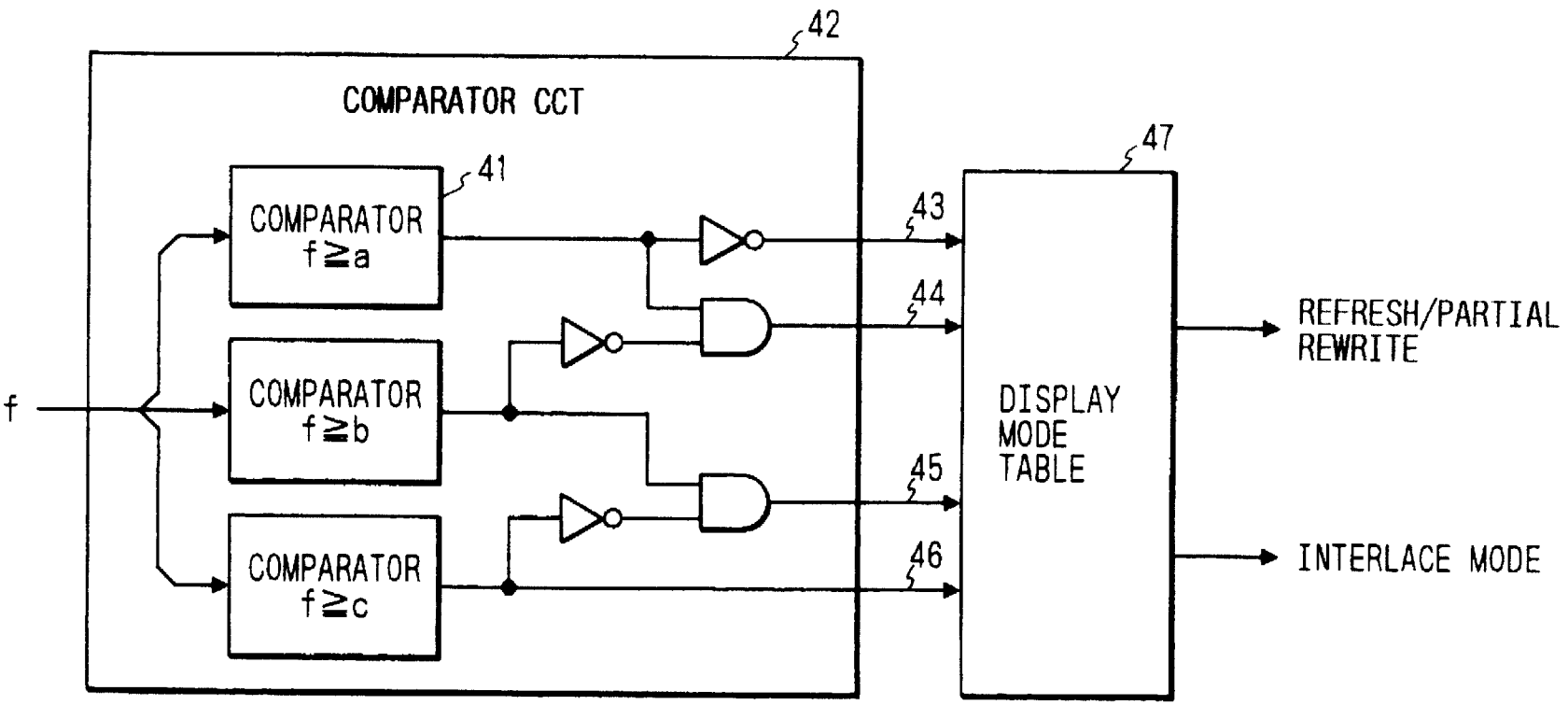
FIG. 4 is a block diagram showing an example of a display mode controller.

Although the embodiment has been described above with respect to a simple example, by selecting the optimum display mode in the display mode controller 27 in accordance with the access frequency of the CPU 1 and the display speed of the FLCD 17, a display image of a high display quality can be obtained. FIG. 4 shows an example to realize such a display mode controller 27.

In FIG. 4, f denotes a counter value from the flag counter 28 and corresponds to the flag counter value 38 in FIG. 3. The counter value is compared with threshold values by a plurality of comparators 41, so that the number of lines which are not display-updated can be known as several stages. In the example, three comparators 41 are Used and signals indicating at which stage among four stages the counter value exists can be generated from a comparator circuit 42. An output signal 43 indicates that $f<a$, an output signal 44 indicates $a \leqq f<b$, an output signal 45 indicates $b \leqq f<c$, and an output signal 46 indicates $f \geqq c$, respectively.

In the display mode table 47, a display mode which is executed at each stage has been predetermined. The display mode indicates either one of the partial rewrite or the total refresh and further includes the interlace mode in the total refresh.

As a method of total refresh, there is a noninterlace such that the lines are continuously updated in accordance with the descending order from the top line to the lower line, a 2-line interlace such that the lines are skipped every other line as seen in the CRT or the like, various random-like interlaces which are peculiar to the FLCD 17, or the like. A proper method is selectively used such that the random-like interlace is executed to suppress a flickering of the screen or a noninterlace is executed to continuously display and update.

In the example shown in FIG. 13, a=2 and b=c=5. The total refresh is set in case of the output signals 43, 45, and 46. The partial rewrite is set in case of the output signal 44. A good display image can be obtained by properly determining the values of a, b, and c from the drawing method of the CPU 1 or the relation between the writing speed of the CPU 1 to the video memory 25 and the display speed of the FLCD 17. For instance, when it is now assumed that the FLCD 17 can display only about two to three lines for a period of time during which the mouse cursor writes the data of 24 lines and the CPU 1 writes the data of 24 lines, in order to correctly display the mouse cursor, a=1 and b=25 and the partial rewrite is executed in a range of $a \leqq f<b$. Due to this, the-mouse cursor is displayed in the partial rewrite mode without flicker. On the other hand, when c=1000 and the noninterlace refresh is executed in a range of $f \geqq c$, in the case where the screen is rewritten by 1000 lines or more, for instance, in case of a screen scroll, the lines are continuously updated, so that characters can be displayed without being disordered.

Figure 5:
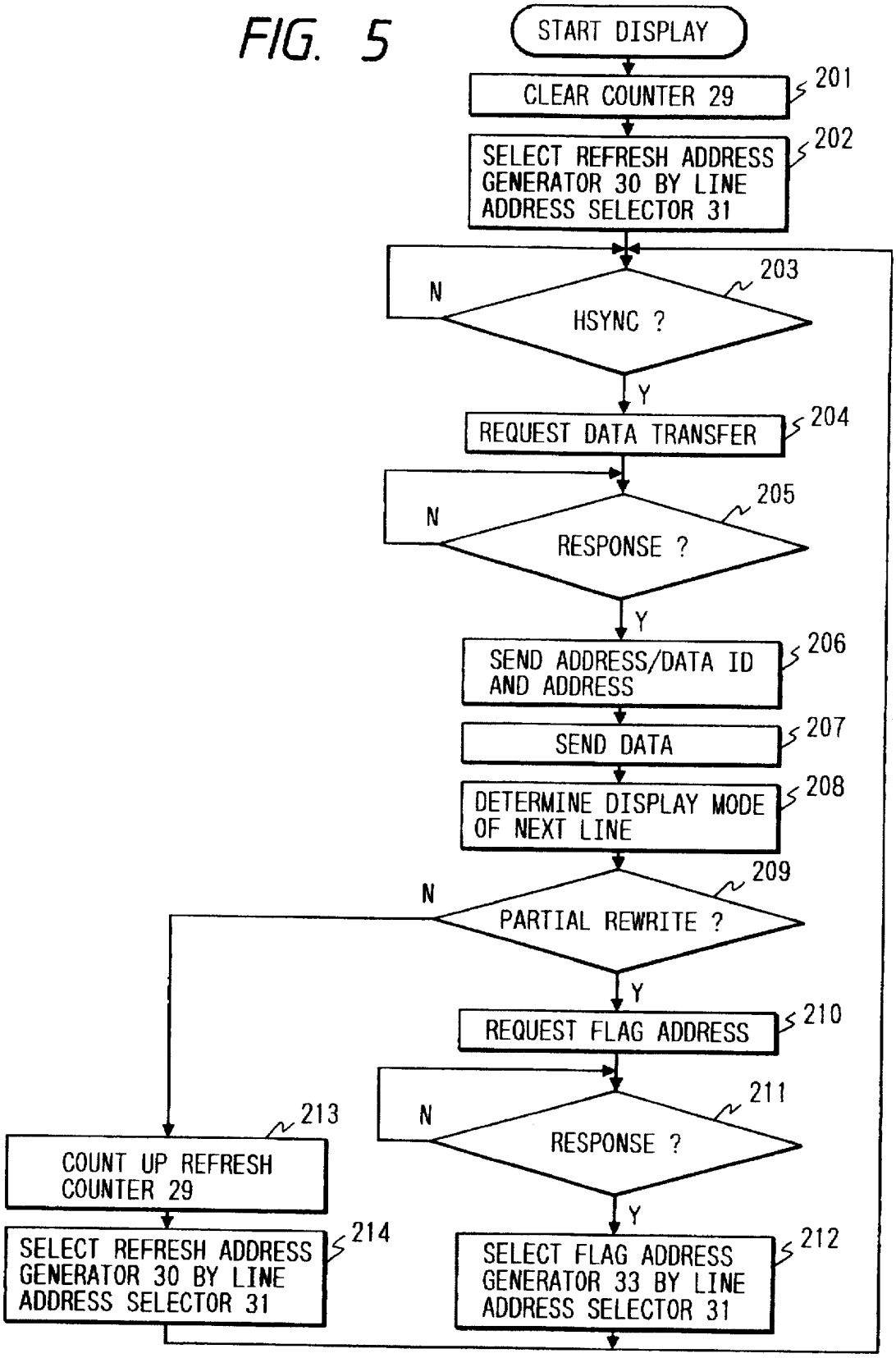
FIG. 5 is a flowchart for explaining the operation of the FLCD interface.

FIG. 5 shows an operation flowchart of the FLCD interface 18 around the display mode controller 27 in the embodiment as a center. When the start of the display is instructed, it is desirable to execute the total refresh from the head line in the first display. Therefore, the refresh counter 29 is cleared to "0" in step 201. The refresh address is selected by the line address selector 31 in step 202. When an HSYNC signal is detected in step 203, the data transfer request 36 is sent to the memory controller 24 in step 204. A data transfer cycle is executed for the video memory 25 and when a response indicating that the data of the relevant line could be prepared is detected in step 205, an address/data ID signal and an address are sent to the FLCD 17 in step 206. Subsequent to the address, data is also sent in step 207. The operations in steps 206 and 207 are executed in the address/data synthesizer. When the transmission of the data is started, the display mode controller determines the display mode of the next line in step 208 as mentioned above. When the partial rewrite mode is set in step 209, the processing routine advances to step 210. If NO, namely, in case of the total refresh, step 213 follows. In the partial rewrite, a flag address is requested to the flag address generator 33 in step 210. When the existence of the response from the flag address generator 33 is confirmed in step 211, the flag address generator 33 is selected by the line address selector 31 in step 212 and the apparatus waits for the input of the next HSYNC signal. In the total refresh, the refresh counter 29 is counted up in step 213. The refresh address generator 30 is selected by the line address selector 31 in step 214. The apparatus waits for the input of the next HSYNC signal.

After that, the above operations are repeated until the display is finished.

Figure 6:
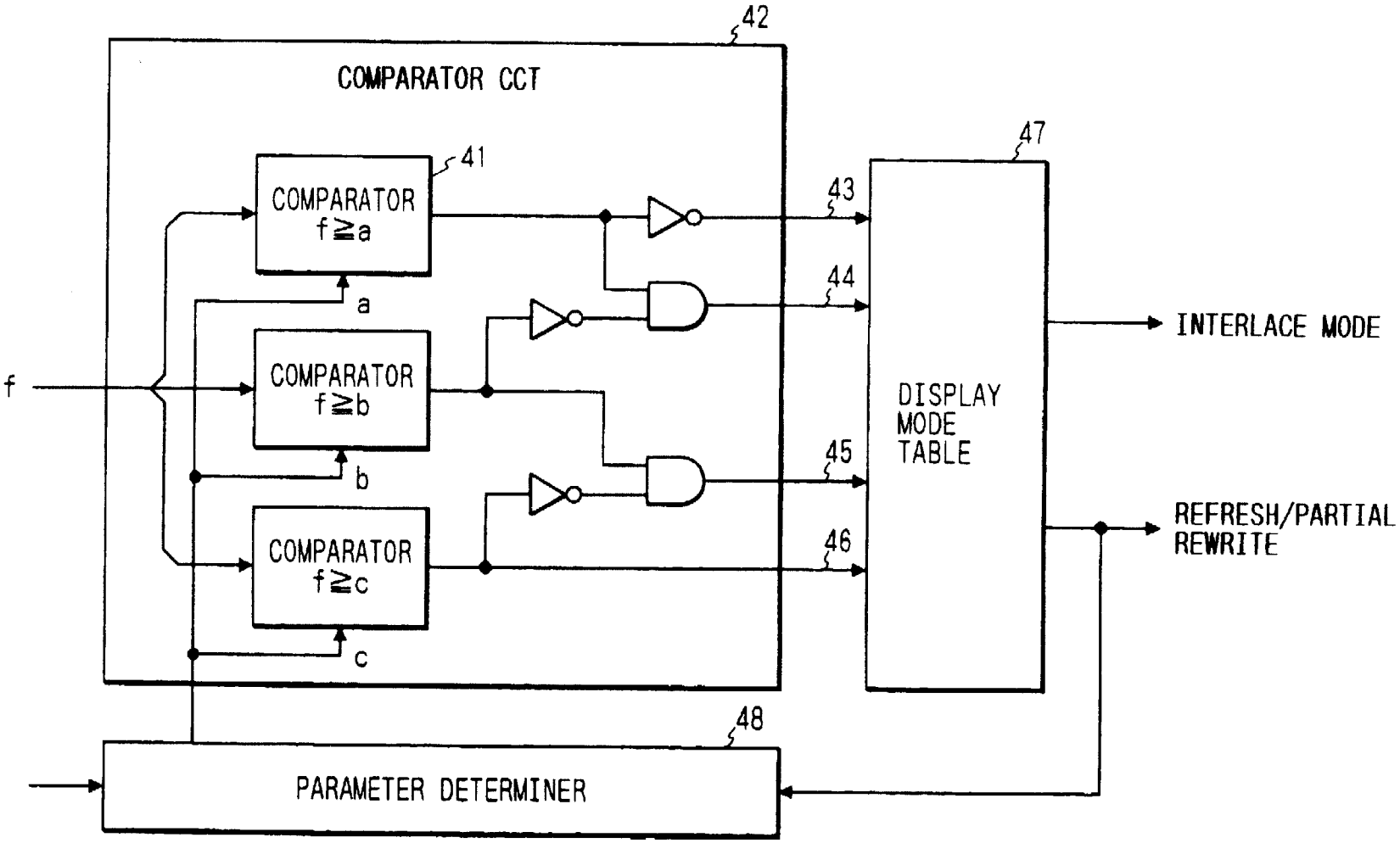
FIG. 6 is a block diagram showing another embodiment of a display mode controller.

FIG. 6 shows another embodiment of the display mode controller 27. In the example of FIG. 4, the parameter values a, b, and c are fixed. However, in another embodiment, the parameter values a, b, and c are dynamically changed by a parameter determiner 48. Namely, the conditions to decide the refresh mode and the partial rewrite mode are changed in accordance with the access statuses of the FLCD 17 and CPU 1.

As factors to decide the parameters, a temperature condition of the FLCD 17, the present display mode, and the like are considered. Since a rewrite speed of the FLCD 17 changes depending on the ambient temperature, the updating period of one line, namely, the period of the HSYNC signal changes. On the other hand, the access speed of the CPU 1 doesn't change due to the temperature. Therefore, when the deciding conditions of the display mode are changed in accordance with the ambient temperature of the FLCD 17, the display control is more finely executed, resulting in the improvement of the display quality.

For instance, the determination between the total refresh cycle and the partial rewrite cycle is executed, for instance, on the basis of the temperature in accordance with FIG. 14.

In the diagram, the temperature condition indicates the ambient temperature of the FLCD 17 and can be known by a sensor attached onto the FLCD 17 or the like.

For instance, when the ambient temperature of the FLCD 17 is equal to or less than 15° C., the temperature condition is set to 0. When the ambient temperature lies within a range of 15° to 20° C., the temperature condition is set to 1; 2 for 20° to 30° C.; and 3° for 30° C. or higher. The temperature condition is selected on, the basis of the ambient temperature and the control is performed in a manner similar to those shown in FIGS. 4 and 13.

By setting the relation between the flag counter value and the display mode every temperature condition as shown in FIG. 14 as mentioned above, the display control can be more finely and easily realized.

When the partial rewrite mode is continuously maintained, there is a possibility such that the lines which are not refreshed occur. To avoid such a situation, there is considered a method whereby when the partial rewrite operation are continuously executed a predetermined number of times, parameters to shift to the partial rewrite mode are changed to thereby limit the number of partial rewrite operations. For instance, in the example of FIG. 13, when the partial rewrite continues, b=c is reduced to 5→4→3, thereby making it difficult to shift to the partial rewrite. It is also considered to be effective to use a method whereby when the total refresh mode is executed, the values of b and c are again returned to b=c=5 and the display mode is decided under the initial conditions. The above method can be also applied to the case where the total refresh mode continues.

Figure 15:
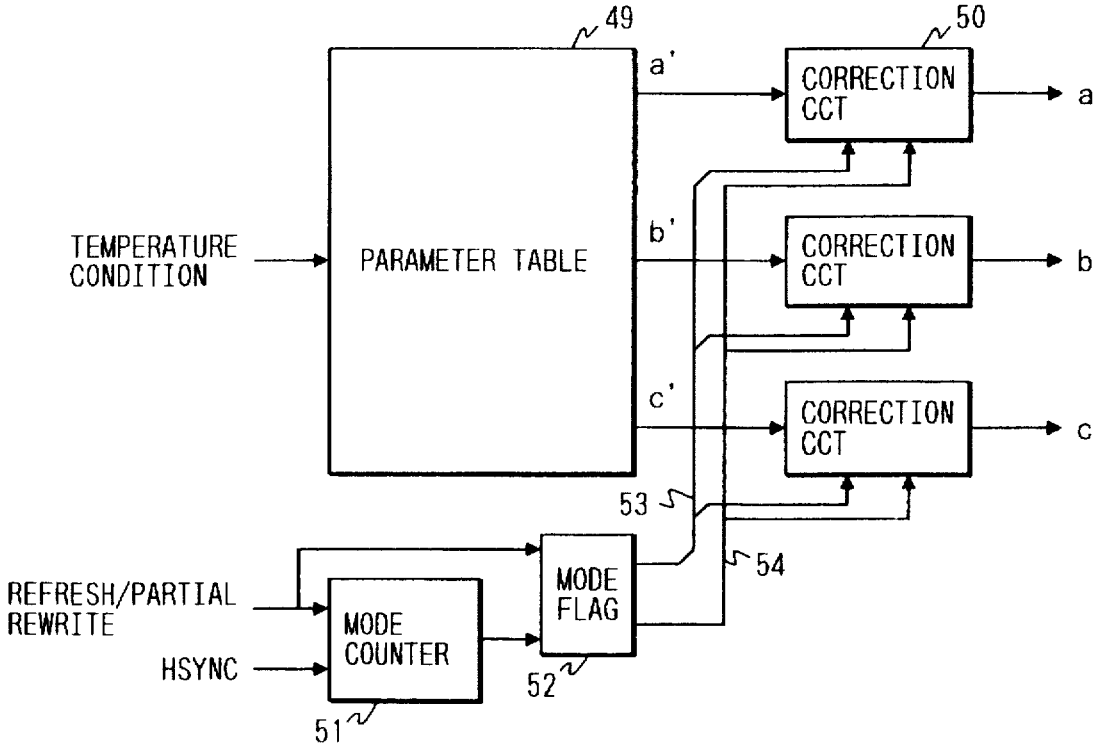
FIG. 15 is a block diagram showing an example of a parameter determiner.

FIG. 15 shows an embodiment of a parameter determiner. In a parameter table 49, reference values a', b', and c' of the parameters are selected and generated in accordance with the temperature condition which is informed from the FLCD 17. In a mode counter 51, the number of continuous total refresh operations or partial rewrite operations is counted by a unit basis of the HSYNC signal. When the total refresh mode or partial rewrite mode continues a predetermined number of times or more, such a fact is informed to a mode flag 52. When such a notification is received, the mode flag 52 gives a correction signal 53 to instruct "+" or "−" for each of the reference values a', b', and c' to a correction circuit 50. In accordance with such an instruction, the correction circuit 50 corrects the values of a', b', and c' and supplies the corrected values a, b, and c to the comparators 42 in FIG. 6.

When the mode is changed, the mode flag 52 gives a return signal 54 to the correction circuit 50 and the correction circuit 50 returns the values a, b, and c to a', b', and c'.

By the circuit as shown in FIG. 15, it is possible to eliminate a problem such that only the partial rewrite mode is executed and the refresh is not performed or only the total refresh is executed and the partial rewrite is not performed.

Another embodiment regarding the flag address generator 33 will now be described hereinbelow.

(1) Although the embodiment has been described with respect to the example in which the FIFO or counter is used in the construction of the flag address generator 33, it can be also easily constructed by using a priority encoder. The output data of the memory 104 of the flag memory 32 is encoded and the encoded output data is used as a flag address, so that the line address can be easily obtained.

(2) In FIG. 9 showing the example in which the counter is used, by adding an address converter to an output signal of the counter 130, the partial rewrite mode can be changed by the count value of the flag counter 28. For instance, when the total number of flags is equal to or less than a predetermined value, the noninterlace mode is set. Namely, the lines to be partially rewritten are sequentially outputted in accordance with the order from the upper line to the lower line and when the flags of the number larger than the predetermined number are set, the interlace mode in the partial rewrite is changed in accordance with the number of set flags, namely, the lines to be partially rewritten are skipped and outputted. The function as mentioned above can be easily added.

Various methods of realizing the present invention are considered and the present invention is not limited to the embodiments shown here.

As described above, according to the embodiment, the apparatus comprises: the means for executing the cycle to sequentially rewrite the whole screen in accordance with the order; the means for executing the cycle to display-update the portion in which the display content has been changed from the host computer side such as a CPU or the like; the means for indicating that the portion in which the display content has been changed is not truly display-updated; and the means for deciding the condition regarding which one of the cycles is executed on the basis of the number of portions which are not yet display-updated among the portions in which the display content has been changed, wherein whether the data is the data to be partially rewritten or not doesn't need to be discriminated by a command from the CPU or the like, and the rewritten data can be immediately displayed without reducing the refresh rate.

Further, the apparatus has: the means which is constructed in a manner such that in order to indicate that the portions in which the display content has been changed are not truly display-updated, when the display content has been changed, the flag corresponding to such a portion is set, and when such a portion is display-updated, the flag is reset to "0"; and the means for searching the location where the flag has been set to "1". Thus, the order to perform the partial rewrite can be accurately searched and the display quality can be raised without a feeling of physical disorder.

Therefore, the screen display can be also made to follow the movement of a figure or a cursor at a high response speed without changing the specifications of the software or the like of the system using the FLC display. It is also possible to preferably display data by making the most of the characteristics of the FLC. In addition, the compatibility among the different display media when they are seen from the system side is also maintained. Moreover, since the apparatus can be realized by a simple circuit construction, the display control can be cheaply executed at a high speed.

(Embodiment 2)

An embodiment 2 of the invention will now be described.

Figure 16:
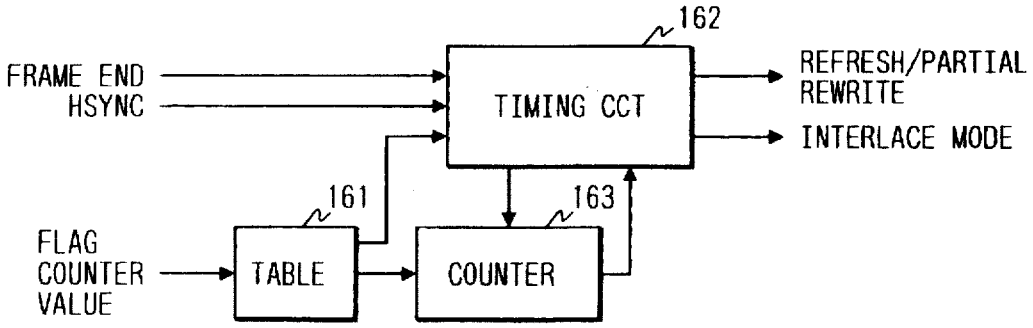
FIG. 16 is a block diagram showing an example of a display mode controller.

FIG. 16 shows an example of the display mode controller 27 embodying the second embodiment.

In FIG. 16, a frame end denotes a signal to inform the end of frame from the refresh counter 29. HSYNC is a data request signal from the FLCD 17. The flag counter value is a counter value which is obtained from the flag counter 28. In the table 41, the flag counter value is converted into the number of partial rewrite operations corresponding to the counter value. A timing circuit 162 determines the end of frame and the display mode every HSYNC. When one frame is finished, so long as the number of partial rewrite operations is not "0", the timing circuit 62 sets a total refresh/partial rewrite signal to the partial rewrite side and also gives a load signal to a counter 163, thereby allowing the number of partial rewrite operations from a table 161 to be loaded. Subsequently, each time the HSYNC signal is supplied, the count value is counted up. When a signal indicative of the end of loaded value is generated from the counter, the total refresh/partial rewrite signal is set to the refresh side. After that, such a state is held until the completion of the refresh operation of one frame.

There is also a case where it is better to change the interlace mode of the refresh in dependence on the flag counter value. In such a case, a notification signal is sent from the table 161 to the timing circuit 162. An interlace mode designation signal is sent from the timing circuit 162.

As a total refresh method, there are methods such as noninterlace to sequentially continuously update the lines in accordance with the order from the top line to the lower line, 2-line interlace such that the lines are skipped every other lines as seen in the CRT or the like, various random-like interlaces which are peculiar to the FLCD 17, and the like. A proper method is selectively used such that the random-like interlace is performed to suppress a flickering of the screen or the noninterlace is performed to continuously execute the display-updating.

Figure 17:
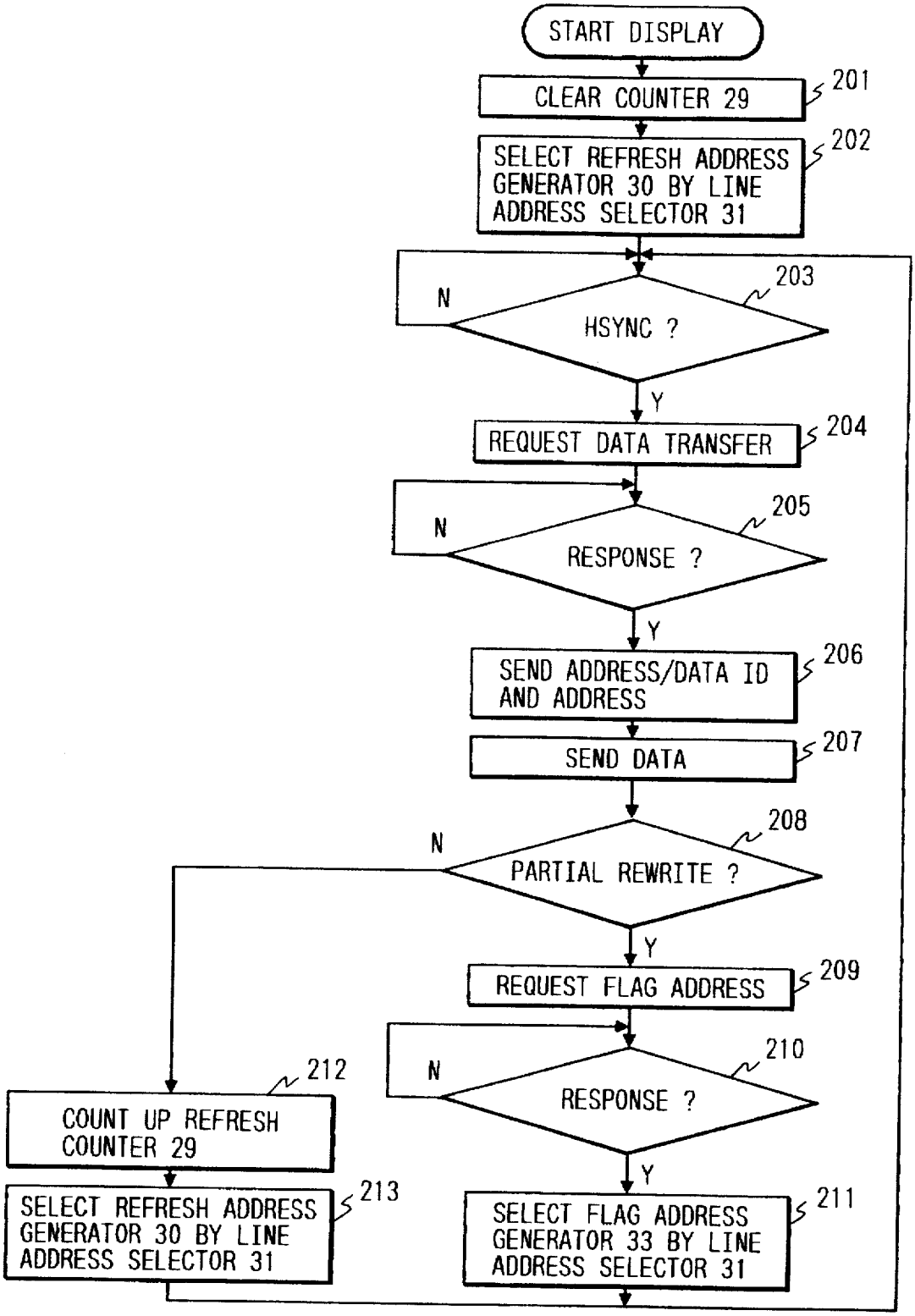
FIG. 17 is a flowchart for explaining the operation of an FLCD interface.

FIG. 17 shows an operation flowchart of the FLCD interface 18 around the display mode controller 27 in the second embodiment. When the start to display is instructed, it is desirable to execute the total refresh from the head line in the first display. Therefore, the refresh counter 29 is cleared to "0" in step 201. The refresh address is selected by the line address selector 31 in step 202. When the HSYNC signal is detected in step 203, the data transfer request 36 is sent to the memory controller 24 in step 204. The data transfer cycle is executed for the video memory 25. When a response indicating that the data of the relevant line could be prepared is detected in step 205, an address/data ID signal and the address are sent to the FLCD 17 in step 206. Subsequent to the address, the data is also sent in step 207. The operations in steps 206 and 207 are executed by the address/data synthesizer 35. When the transmission of the data is started, the display mode controller 27 executes an output preparation of the next line. When the partial rewrite mode is set in step 208, step 209 follows. If NO in step 208, namely, when the total refresh mode is set, step 212 follows. In the partial rewrite mode, the flag address is requested to the flag address generator 33 in step 209. When it is confirmed in step 210 that the response has been sent from the flag address generator 33, the flag address generator 33 is selected by the line address selector 31 in step 211. The apparatus waits for the input of the next HSYNC signal. In the total refresh mode, the refresh counter 29 is counted up in step 212. The refresh address generator 30 is selected by the line address selector 31 in step 213. The apparatus waits for the input of the next HSYNC. The above Operations are repeated until the completion of the display after that.

Figure 18:
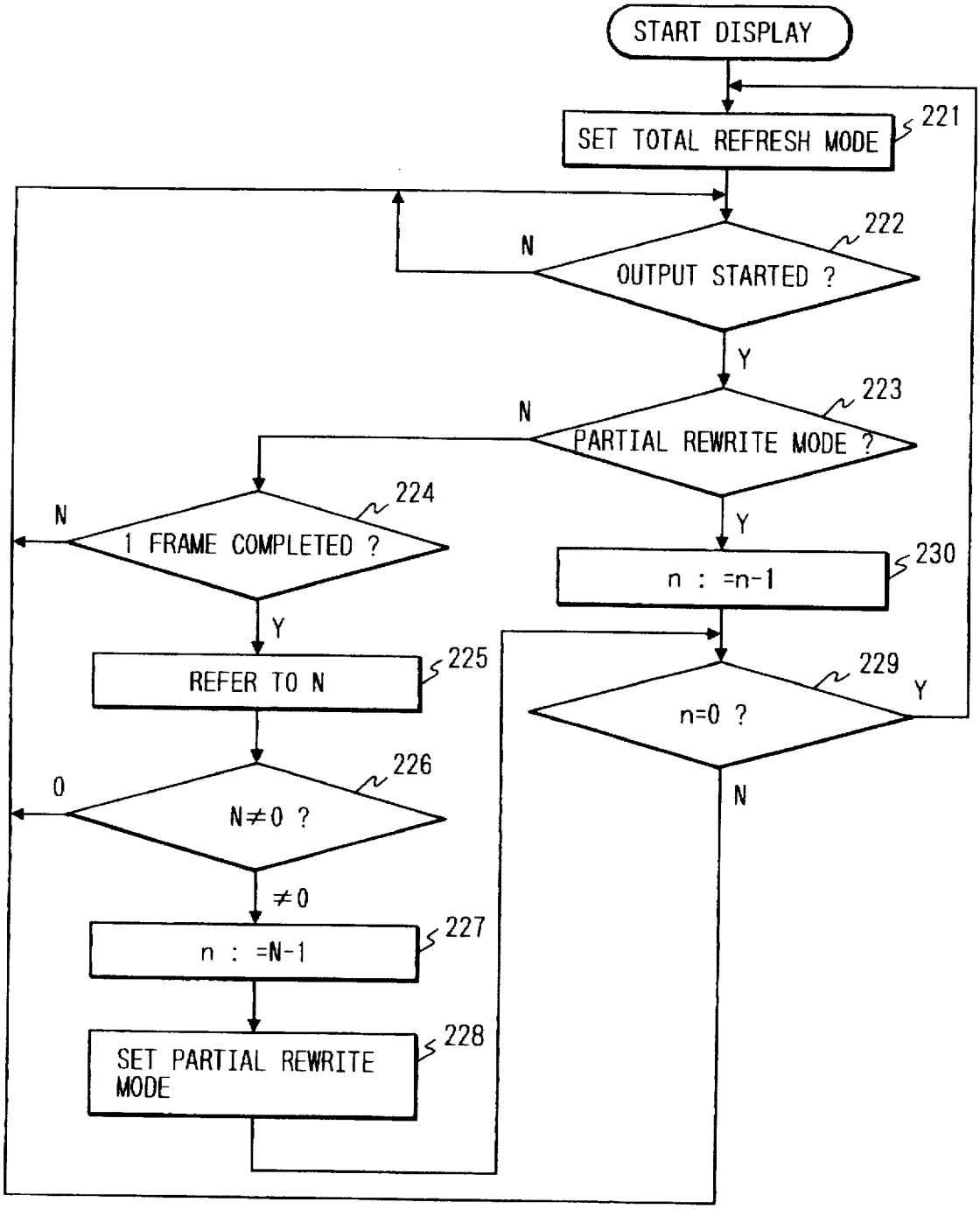
FIG. 18 is a flowchart for explaining the operation of a timing circuit in a display mode controller.

The operation of the section to set either one of the total refresh mode and the partial rewrite mode, namely, the operation of the timing circuit 162 in FIG. 16 will now be described with reference to an operation flowchart of FIG. 18.

When the display is started, the total refresh mode is set in step 221. When it is confirmed in step 222 that the data transmission in step 207 in FIG. 17 has been started, step 223 follows. Since the total refresh mode is set as an initial mode, step 224 follows. After the apparatus waited for completion of the execution of the total refresh of the data of one frame, the apparatus refers to the number (assumes N) of partial rewrite operations which is derived from the table 161 in step 225. When N="0" in step 226, the processing routine is returned to step 222 and the total refresh mode is continued by an amount of one frame. When N≠"0" in step 226, N−1 is substituted for a control variable n in step 227. Such a substitution corresponds-to the loading into the counter 163 in FIG. 16. After the partial rewrite mode was set in step 228, a check is made in step 229 to see if n=0 or not. Namely, such a discrimination in step 229 is made to judge whether the partial rewrite operations of the set number of times have been executed or not. The partial rewrite operations of the set number of times are not yet executed in step 229, step 222 follows and the apparatus waits for the execution of the next partial rewrite operation. In this case, after step 223, N−1 is substituted for the control variable n in step 230. The processing routine advances to step 229. When it is decided in step 229 that the partial rewrite operations of the set number of times have been executed, the processing routine is returned to step 221. The total refresh mode is again set. The apparatus waits for the next output.

When the number of partial rewrite operations is determined from the flag counter value, it is a simple method that a predetermined fixed table is used. It is also considered that such a table is changed due to some factors. As such factors, a temperature condition of the FLCD 17, the number of past partial rewrite operations, and the like are considered. Since the rewriting speed of the FLCD 17 changes depending on the ambient temperature, the updating time of one line, namely, the period of the HSYNC signal changes. On the other hand, the access speed of the CPU 1 doesn't change due to the temperature. Therefore, by changing the deciding conditions of the display mode in dependence on the ambient temperature of the FLCD 17, the display control is more finely executed, resulting in the improvement of the display quality.

There is also considered that a peculiar pattern occurs in the number of partial rewrite operations in accordance with the updated contents of the display. To avoid the generation of such a peculiar pattern, there is considered a method whereby when the number of partial rewrite operations reaches the value such as to cause a certain pattern, the relation between the flag counter value and the number of partial rewrite operations is changed.

To realize the above method, for instance, there is considered a method whereby a plurality of tables 161 in FIG. 16 are prepared and one of those tables is selected on the basis of the information from a circuit to monitor the temperature condition of the FLCD 17 or the number of partial rewrite operations.

Figure 21:
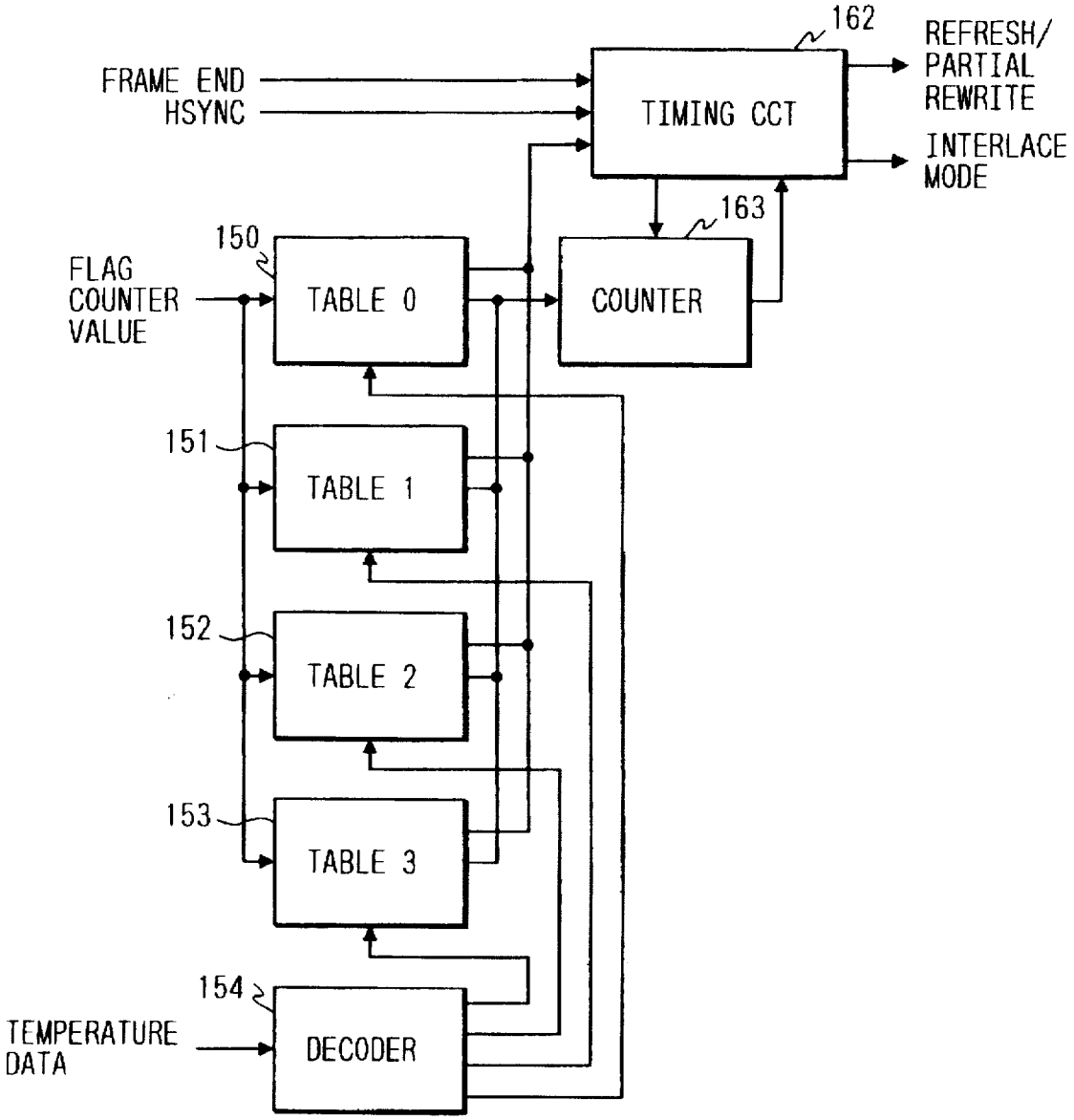
FIG. 21 is a block diagram showing a display mode controller.

FIG. 21 shows an embodiment for selecting one kind of table on the basis of the information from the circuit to monitor the temperature condition of the FLCD 17. In the embodiment, the temperature condition is notified as data of two bits from the FLCD. The temperature condition can be known from a sensor or the like attached to the FLCD 17. The temperature condition of two bits is decoded by a decoder 154. Thus, one of four tables (table-0 150, table-1 151, table-2 152, table-3 153) is selected and the number of partial rewrite operations which are executed is determined from the contents of the selected table and the flag counter value. FIG. 22 shows the correspondence relation between the temperature condition and the table which is selected.

When the ambient temperature of the FLCD 17 is low, the temperature condition is set to "00". When the ambient temperature is high, the temperature condition is set to "11". In this manner, the temperature condition changes step by step in a range from "00" to "11" in accordance with the ambient temperature of the FLCD 17. Due to this, when the ambient temperature of the FLCD 17 is low and the rewriting speed is slow, the number of partial rewrite operations which are executed is reduced. When the ambient temperature of the FLCD 17 is high and the rewriting speed is fast, the number of partial rewrite operations which are executed is increased. Due to this, a high display quality can be held without being influenced by the ambient temperature.

According to the embodiment as described above, the apparatus comprises: the means for executing the cycle to display-update the portions in which the display content has been changed from the host computer side such as a CPU or the like during the step of executing the cycle for sequentially rewriting the display content of the whole screen; the means for indicating that the portions in which the display content has been changed are not truly display-updated; and the means for deciding the number of times of the cycle to display-update the portions in which the display content has been changed on the basis of the number of portions which are not yet display-updated among the portions in which the display content has been changed, wherein a discrimination regarding whether the data is the data to be partially rewritten or not doesn't need to be executed by a command from the CPU or the like, and the rewritten data can be immediately displayed without reducing the refreshing rate. Further, by using the searching means for searching the portions in which the display content has been changed, the portion to be partially rewritten can be accurately judged and the display can be obtained at a high quality.

Therefore, the display content on the screen can be allowed to trace the movement of the figure or cursor at a high response speed without changing the specifications of the software or the like of the system using the FLC display. Further, a good display can be executed by making the most of the characteristics of the FLC. On the other hand, compatibility between the CRT and the FLC when they are seen from the system side is also maintained. In addition, since the apparatus is realized by a simple circuit construction, the display control can be economically performed at a high speed.

What is claimed is:

1. A display control apparatus comprising:

memory means comprising a plurality of predetermined areas for storing display information;

supply means for supplying the display information stored in said memory means to a display device having a screen;

a plurality of flag means, each having a flag, provided in correspondence with respective different areas of said memory means;

flag number memory means for storing the number of flags;

set means for setting at least one of said plurality of flag means in response to updating the display information stored in at least one of the areas of said memory means corresponding to said at least one flag means and, when one of said plurality of flag means is set, for adding 1 to the number of flags stored in said flag number memory means;

reset means for resetting at least one of said plurality of flag means in response to supply of the display information stored in at least one of the areas of said memory means corresponding to said at least one flag means to the display device by said supply means and, when one of said plurality of flag means is reset, for subtracting 1 from the number of flags stored in said flag number memory means; and selection means for selecting, each time data corresponding to one flag is transferred to the display and in response to the number of flags stored in said flag number memory means, either one of a first mode in which said supply means is controlled to update display of the entire screen of the display device and a second mode in which display of a part of the screen of the display device is updated.

2. An apparatus according to claim 1, wherein said supply means preferentially supplies the display information stored in the at least one area of said memory means corresponding to said at least one flag means set by said set means to the display device in the second mode.

3. An apparatus according to claim 1, further comprising means for detecting an external condition, wherein said selection means selects either one of the first and second modes in response to the number of flag means set by said set means and the external condition detected by said detection means.

4. An apparatus according to claim 3, wherein the external factor includes a temperature of the display device.

5. An information processing apparatus comprising:

memory means comprising a plurality of predetermined areas for storing display information;

a display device, having a screen, for displaying display information;

supply means for supplying the display information stored in said memory means to said display device;

a plurality of flag means, each having a flag, provided in correspondence with respective different areas of said memory means;

flag number memory means for storing the number of flags;

set means for setting at least one of said plurality of flag means in response to updating the display information stored in at least one of the areas of said memory means corresponding to said at least one flag means and, when one of said plurality of flag means is set, for adding 1 to the number of flags stored in said flag number memory means;

reset means for resetting at least one of said plurality of flag means in response to supply of the display information stored in at least one of the areas of said memory means corresponding to said at least one flag means to said display device by said supply means and, when one of said plurality of flag means is reset, for subtracting 1 from the number of flags stored in said flag number memory means; and selection means for selecting, each time data corresponding to one flag is transferred to the display and in response to the number of flags stored in said flag number memory means, either one of a first mode in which said supply means is controlled to update display of said entire screen of said display device and a second mode in which display of a part of said screen of said display device is updated.

6. An apparatus according to claim 5, wherein said supply means preferentially supplies the display information stored in the at least one area of said memory means corresponding to said at least one flag means set by said set means to said display device in the second mode.

7. An apparatus according to claim 5, further comprising means for detecting an external condition, wherein said selection means selects either one of the first and second modes in response to the number of flag means set by said set means and the external condition detected by said detection means.

8. An apparatus according to claim 7, wherein the external condition includes a temperature of said display device.

9. A method for controlling a display apparatus, comprising the steps of:

storing display information in a first memory having a plurality of predetermined areas;

supplying the display information stored in the first memory to a display device having a screen;

providing a plurality of flags corresponding to respective different areas of the first memory;

storing the number of flags in a second memory;

setting at least one of said plurality of flags in response to updating the display information stored in at least one of the areas of the memory corresponding to at least one flag and, when one of said plurality of flag means is set, adding 1 to the number of flags stored in the second memory;

resetting at least one of the plurality of flags in response to the supply of display information stored in at least one of the areas in the first memory corresponding to the at least one flag to the display device and, when one of said plurality of flag means is reset, subtracting 1 from the number of flags stored in the second memory; and selecting, each time data corresponding to one flag is transferred to the display and in response to the number of flags stored in the second memory, either one of a first mode in which display information is supplied to update display of the entire screen of the display device and a second mode in which part of the screen of the display device is updated.

10. A method according to claim 9, further comprising the step of preferentially supplying the display information stored in at least one area of the first memory corresponding to the at least one flag to the display device in the second mode.

11. A method according to claim 9, further comprising the step of detecting an external condition, wherein either one of the first and second modes is selected in response to the number of flags set in the detected external condition.

12. A method according to claim 11, further comprising the step of detecting a temperature of the display device as the external condition.

* * * * *

UNITED STATES PATENT AND TRADEMARK OFFICE

CERTIFICATE OF CORRECTION

PATENT NO. : 5,717,420
DATED : February 10, 1998
INVENTOR(S) : Matsuzaki et al.

It is certified that error appears in the above-identified patent and that said Letters Patent is hereby corrected as shown below:

COLUMN 1:

Line 47, "the." should read --the--.
Line 55, "apply" should read --application--.

COLUMN 9:

Line 27, "10" should be deleted.

COLUMN 10:

Line 38, "the-mouse" should read --the mouse--.

COLUMN 14:

Line 21, "waited" should read --waits--.

Signed and Sealed this

Twenty-fourth Day of November, 1998

*Attest:*

Bruce Lehman

BRUCE LEHMAN

*Attesting Officer*

*Commissioner of Patents and Trademarks*